US012263988B2

(12) United States Patent
Lee et al.

(10) Patent No.: US 12,263,988 B2
(45) Date of Patent: Apr. 1, 2025

(54) COLLAPSIBLE STORAGE CONTAINERS AND RELATED METHODS

(71) Applicant: TOPS Products LLC, Chicago, IL (US)

(72) Inventors: Su Chew Lee, Singapore (SG); Stephen Bantle, Edwardsville, IL (US)

(73) Assignee: TOPS PRODUCTS LLC, Chicago, IL (US)

( * ) Notice: Subject to any disclaimer, the term of this patent is extended or adjusted under 35 U.S.C. 154(b) by 21 days.

(21) Appl. No.: 18/167,488

(22) Filed: Feb. 10, 2023

(65) Prior Publication Data

US 2024/0270442 A1 Aug. 15, 2024

(51) Int. Cl.
*B65D 6/18* (2006.01)

(52) U.S. Cl.
CPC ..... *B65D 11/1853* (2013.01)

(58) Field of Classification Search
CPC .. B65D 11/1853; B65D 7/26; B65D 11/1813; B65D 21/0204; B65D 11/18
See application file for complete search history.

(56) References Cited

U.S. PATENT DOCUMENTS

| | | | |
|---|---|---|---|
| D423,587 | S | 4/2000 | Conley |
| D425,562 | S | 5/2000 | Conley |
| D518,526 | S | 4/2006 | Benn |
| D668,047 | S | 10/2012 | Cenzano et al. |
| D668,051 | S | 10/2012 | Cenzano et al. |
| D671,318 | S | 11/2012 | Schmidt et al. |
| D671,742 | S | 12/2012 | Cenzano et al. |
| D671,743 | S | 12/2012 | Cenzano et al. |
| D677,463 | S | 3/2013 | Cenzano et al. |
| D677,465 | S | 3/2013 | Cenzano et al. |
| D677,555 | S | 3/2013 | Cenzano et al. |
| D677,899 | S | 3/2013 | Cenzano et al. |
| D680,746 | S | 4/2013 | Schmidt et al. |

(Continued)

FOREIGN PATENT DOCUMENTS

| | | | |
|---|---|---|---|
| CN | 305742066 | S | 4/2020 |
| CN | 117842501 | A | 4/2024 |

(Continued)

OTHER PUBLICATIONS

Taiwan Intellectual Property Office, "Notice of preliminary review opinion and Search Report," issued in connection with Taiwanese Patent Application No. 112133785, dated Aug. 23, 2024, 21 pages [including translation].

(Continued)

*Primary Examiner* — Shawn M Braden
(74) *Attorney, Agent, or Firm* — Hanley, Flight & Zimmerman, LLC

(57) ABSTRACT

Collapsible storage containers and related methods are disclosed. An example collapsible storage container movable between a deployed position and a collapsed position disclosed herein includes a front panel, a back panel, a side panel including a first side panel portion coupled to the front panel, the first side panel portion including a first face and a second side panel portion coupled to the back panel, the second side panel portion including a second face, the first face coplanar with the second face in the deployed position, the first face parallel to and abutting the second face in the collapsed position.

20 Claims, 21 Drawing Sheets

(56) References Cited

U.S. PATENT DOCUMENTS

| | | | | |
|---|---|---|---|---|
| D684,768 | S | 6/2013 | Cenzano et al. | |
| D688,459 | S | 8/2013 | Schmidt et al. | |
| D688,460 | S | 8/2013 | Schmidt et al. | |
| D710,442 | S | 8/2014 | Stravitz | |
| D801,688 | S | 11/2017 | Holland | |
| D808,258 | S | 1/2018 | Lee | |
| D812,467 | S | 3/2018 | Lee | |
| D847,509 | S | 5/2019 | Quinn | |
| D889,828 | S | 7/2020 | Georgi | |
| D961,930 | S | 8/2022 | Song | |
| 11,873,595 | B2 | 1/2024 | Cohen | |
| 2015/0375558 | A1 | 12/2015 | Ben-Or | |
| 2019/0225375 | A1* | 7/2019 | Sena | A47G 29/20 |
| 2022/0194659 | A1* | 6/2022 | Xiao | B65D 25/06 |

FOREIGN PATENT DOCUMENTS

| | | | |
|---|---|---|---|
| TW | 201305026 | A | 2/2013 |
| TW | M571841 | U | 12/2018 |

OTHER PUBLICATIONS

Taiwan Intellectual Property Office, "Examination Report," issued in connection with Taiwanese Patent Application No. 112304041, dated Jan. 12, 2024, 4 pages. [English language machine translation included.].

The State Intellectual Property Office of People's Republic of China, "The First Office Action," issued in connection with Chinese Patent Application No. 202330508975.5, dated May 20, 2024, 2 pages. [English language machine translation included.].

Intellectual Property India, "Examination Report," issued in connection with Indian Patent Application No. 392372-001, dated Sep. 29, 2023, 2 pages.

Intellectual Property India, "Examination Report," issued in connection with Indian Patent Application No. 392373-001, dated Oct. 4, 2023, 2 pages.

Taiwan Intellectual Property Office, "Notice of Allowance," issued in connection with Taiwanese Patent Application No. 112304041, dated May 2, 2024, 10 pages. [English language machine translation included.].

"Xowine 4-Pack Collapsible Plastic Storage Cubes Organizer", [Posted Online on amazon.ca], [First Available Date Apr. 25, 2020], [Retrieved Online on Jan. 3, 2025], https://www.amazon.ca/Xowine-Plastic-Storage-Basket-Organizer/dp/B087N8M3LK (Year:2020).

Cardboard File Box for Letter Size Hanging Folder Storage, [Posted Online on amazon.sg], [First Available Date Aug. 11, 2022], [Retrieved Online on Jan. 3, 2025], https://www.amazon.sg/Cardboard-Hanging-Storage-Collapsible-Organizer/dp/BOB9B83XYW (Year: 2022).

Vababa 4-Pack Floding Storage Bin, [Posted Online on amazon.com], [First Available Date Jul. 9, 2020], [Retrieved Online on Jan. 3, 2025], https://www.amazon.com/Vababa-Plastic-Storage-Rectangle-Organizer/dp/B08CMQNVKF (Year: 2020).

"Pendaflex Mobile File Box with Handles", [Posted Online on amazon.com], [First Available Date Jan. 24, 2023], [Retrieved Online on Jan. 3, 2025], https://www.amazon.com/Pendflex-Mobile-Handles-Collapse-126119/dp/B0BSZDBXMH (Year: 2023).

United States Patent and Trademark Office, "Non-Final Office Action," issued in connection with U.S. Appl. No. 29/871,054, dated Jan. 15, 2025, 11 pages.

* cited by examiner

COLLAPSIBLE STORAGE CONTAINERS AND RELATED METHODS

FIELD OF THE DISCLOSURE

This disclosure relates generally to storage devices and, more particularly, to collapsible storage containers and related methods.

BACKGROUND

Storage boxes are used to store and protect objects placed therein. Some storage boxes can be manufactured and shipped in a folded state to facilitate the shipping handling of these boxes prior to consumer use. Many storage boxes are composed of heavy paper materials, such as card stock and/or corrugated cardboard. Such storage boxes can be unfolded, held in a deployed position via a fastener (e.g., tape, etc.), and used to store and protect items placed therein.

BRIEF DESCRIPTION OF THE DRAWINGS

In general, the same reference numbers will be used throughout the drawing(s) and accompanying written description to refer to the same or like parts. The figures are not to scale.

Figure 1:
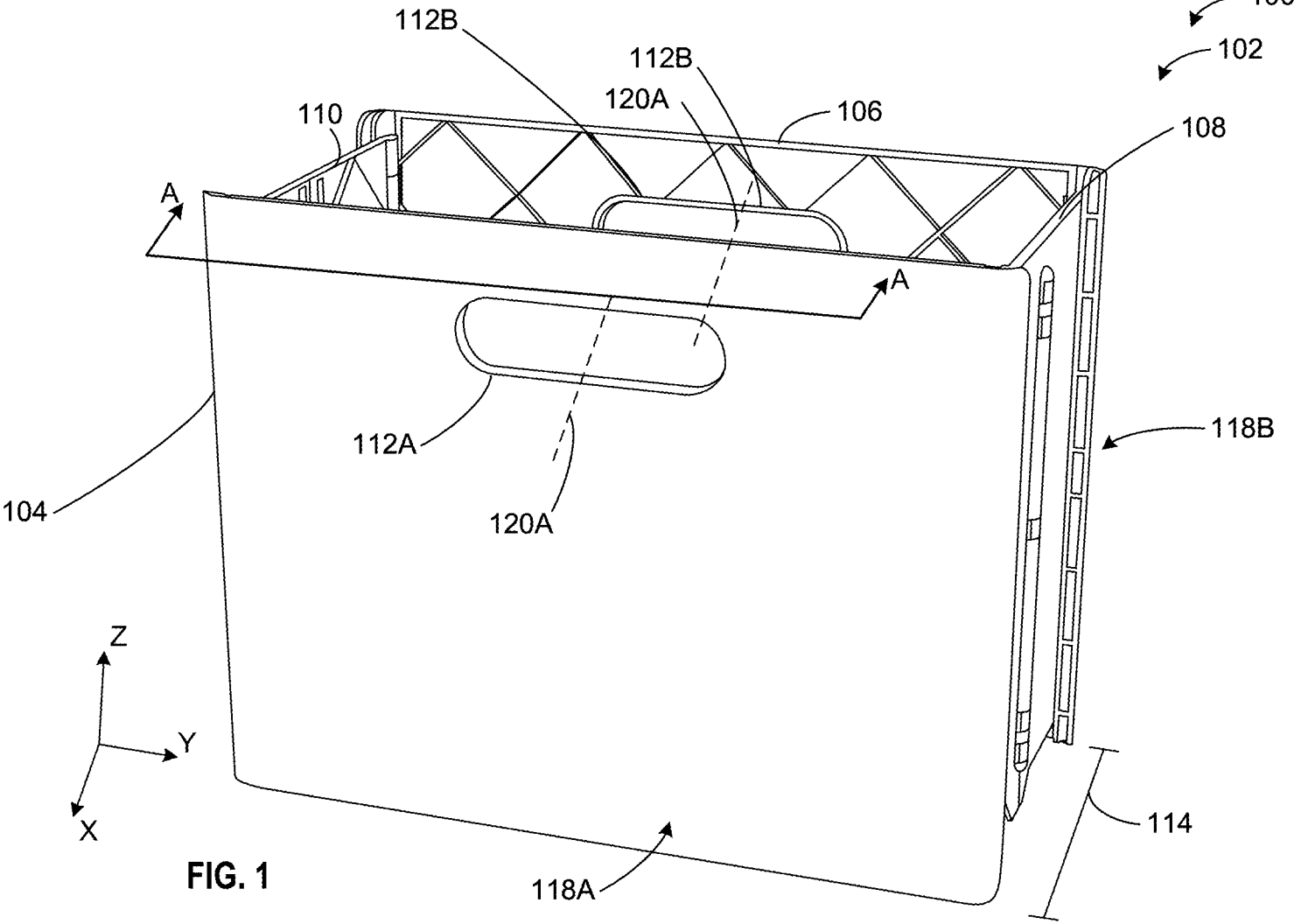
FIG. 1 is a perspective front view of an example collapsible storage container in a deployed position and implemented in accordance with the teachings of this disclosure.

In general, the attached figures are annotated with a set of axes including the vertical axis Z, the horizontal axis X, and the lateral axis Y. As used herein, the term "vertical" refers to directions parallel to the vertical axis Z. As used herein, the term "longitudinal" refers to directions parallel to the horizontal axis X. As used herein, the term "lateral" refers to directions parallel to the lateral axis Y.

DETAILED DESCRIPTION

Examples disclosed herein include a storage container movable between a deployed position and a collapsed position. In some examples disclosed herein, the collapsible storage container includes side panels with side joints that enable the side panels to move between the deployed position and the collapsed position. The side panels are coupled to the front panel and the rear panel via corner joints. In some such examples disclosed herein, the corner joints and the side joints permit the side panels to fold inward to collapse the storage container. In some examples disclosed herein, the side panels include a press fit interface which retains the side panels in a linear position when the storage container is in the deployed position. In some examples disclosed herein, the storage container includes a bottom panel that is coupled to the front panel via a first joint and the rear panel via a second joint. In some such examples disclosed herein, the first joint and/or second joint can be disengaged and the bottom panel can be folded towards a respective one of the rear panel and the front panel via the engaged one of the first joint or the second joint. In some examples disclosed herein, the front panel includes a tab that retains the bottom panel in the planar position when the collapsed storage container is in the collapsed position.

As used herein, "approximately" and "about" modify their subjects/values to recognize the potential presence of variations that occur in real world applications. For example, "approximately" and "about" may modify dimensions that may not be exact due to manufacturing tolerances and/or other real world imperfections as will be understood by persons of ordinary skill in the art. For example, "approximately" and "about" may indicate such dimensions may be within a tolerance range of +/−10% unless otherwise specified in the below description. In some examples used herein, the term "substantially" is used to describe a relationship between two parts that is within three degrees of the stated relationship (e.g., a substantially colinear relationship is within three degrees of being linear, a substantially coplanar relationship is within three degrees of being coplanar, a substantially perpendicular relationship is within three degrees of being perpendicular, a substantially parallel relationship is within three degrees of being parallel, a substantially flush relationship is within three degrees of being flush, etc.).

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc., may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, or (7) A with B and with C. As used herein in the context of describing structures, components, items, objects, and/or things, the phrase "at least one of A and B" is intended to refer to implementations including any of (1) at least one A, (2) at least one B, or (3) at least one A and at least one B. Similarly, as used herein in the context of describing structures, components, items, objects and/or things, the phrase "at least one of A or B" is intended to refer to implementations including any of (1) at least one A, (2) at least one B, or (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, or (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, or (3) at least one A and at least one B.

As used herein, singular references (e.g., "a", "an", "first", "second", etc.) do not exclude a plurality. The term "a" or "an" object, as used herein, refers to one or more of that object. The terms "a" (or "an"), "one or more", and "at least one" are used interchangeably herein. Furthermore, although individually listed, a plurality of means, elements or method actions may be implemented by, e.g., the same entity or object. Additionally, although individual features may be included in different examples or claims, these may possibly be combined, and the inclusion in different examples or claims does not imply that a combination of features is not feasible and/or advantageous.

FIG. 1 is a perspective front view of an example collapsible storage container 100 implemented in accordance with the teachings of this disclosure. In the illustrated example of FIG. 1, the collapsible storage container 100 is an example deployed position 102 (e.g., a deployed state, an extended position or state, an opened position or state, an unfolded position or state, an uncollapsed position or state, etc.). In the illustrated example of FIG. 1, the collapsible storage container 100 includes an example front panel 104, an example rear panel 106, an example first side panel 108, and an example second side panel 110. In the illustrated example, the front panel 104 includes an example first handle 112A and the rear panel 106 includes an example second handle 112B. In the illustrated example of FIG. 1, the collapsible storage container 100 has an example deployed horizontal length 114 in the deployed position 102. The example collapsible storage container 100 is movable between the deployed position 102 and a collapsed position. An example collapsed position of the collapsible storage container 100 is described in conjunction with FIG. 2, 12A, and 12B.

The front panel 104 and the rear panel 106 are structural components of the collapsible storage container 100. In the illustrated example of FIG. 1, the front panel 104 and the rear panel 106 are generally rectangular. In other examples, the front panel 104 and the rear panel 106 can have any other suitable shape (e.g., a different polygon, etc.). In the illustrated example of FIG. 1, the front panel 104 and the rear panel are planar members disposed parallel to the vertical-lateral plane and are orthogonal to the side panels 108, 110. In the illustrated example of FIG. 1, the front panel 104 and the rear panel 106 have substantially the same size and shape (e.g., the front panel 104 and the rear panel 106 have substantially the same dimensions along the vertical, horizontal, and lateral axes, etc.). In some such examples, the front panel 104 and the rear panel 106 are interchangeable components. In other examples, the front panel 104 and the rear panel 106 can have different sizes and/or shapes. The front panel 104 and the rear panel 106 can be composed of one or more plastics (e.g., polyethylene terephthalate, polyethylene, polyvinyl chloride, polypropylene, etc.), one or more metals (e.g., aluminum, carbon steel, stainless steel, tin, brass, etc.), one or more composite materials (e.g., a paper composite, reinforced plastics, etc.), and/or one or more organic materials (e.g., paper, wood, card stock, etc.). In some examples, the exterior faces 118A, 118B of the front panel 104 and the rear panel 106 include an external rigid pattern (not illustrated). In some examples, the external rigid pattern improves the ability of a user of the collapse storage container 100 to grip the front panel 104 and the rear panel 106. The front panel 104 and/or the rear panel 106 are described below in additional detail in FIGS. 2, 3, 5, 6A, 7, 10, 11A, 12A, and 12B.

The handles 112A, 112B are openings in the front panel 104 and the rear panel 106, respectively, that allow a user to grip the collapsible storage container 100. For example, the handles 112A, 112B can be dimensioned along the vertical and lateral axes to enable the fingers of a user to extend therethrough. In other examples, the handles 112A, 112B can have any other suitable size. In the illustrated example of FIG. 1, the handles 112A, 112B are pill-shaped (e.g., stadium-shaped, disco-rectangular, obround, etc.). In other examples, the handles 112A, 112B can have any other suitable shape (e.g., ovoid, rectangular, polygonal, etc.). In the illustrated example of FIG. 1, the handles 112A, 112B have substantially the same size and shape. In other examples, the handles 112A, 112B can have different sizes and/or shapes.

In the illustrated example of FIG. 1, the handles 112A, 112B are centered relative to the lateral axis on the front panel 104 and rear panel 106, respectively. The handles 112A, 112B define an example centerline axis 120A and an example second centerline axis 120B, respectively. In the illustrated example of FIG. 1, the centerline axes 120A, 120B of the handles 112A, 112B are aligned such that the handles 112A, 112B have the same relative positions on the front panel 104 and the rear panel 106, respectively. In other examples, the handles 112A, 112B can have different positions on the front panel 104 and the rear panel 106, respectively. In the deployed position 102, the centerline axes 120A, 120B are substantially colinear. In other examples, the centerline axes 120A, 120B can have any other suitable position in the deployed position 102. Additionally or alternatively, the handles 112A, 112B can be formed in the side panels 108, 110. In some examples, the handles 112A, 112B are absent.

The side panels 108, 110 are structural components of the collapsible storage container 100. In the illustrated example of FIG. 1, the side panels 108, 110 are generally rectangular. In other examples, the side panels 108, 110 can have any other suitable shape (e.g., a different polygon, etc.). In the deployed position 102, the side panels 108, 110 are planar members disposed parallel to the vertical-horizontal plane and are orthogonal to the front panel 104 and the back panel 106. In the illustrated example of FIG. 1, the side panels 108, 110 have substantially the same size and shape (e.g., the side panels 108, 110 have substantially the same dimensions along the vertical, horizontal, and lateral axes, etc.). In some such examples, the side panels 108, 110 are interchangeable components. In other examples, the side panels 108, 110 can have different dimensions along one or more of the vertical, horizontal, and lateral axes. The side panels 108, 110 can be composed of one or more plastics (e.g., polyethylene terephthalate, polyethylene, polyvinyl chloride, polypropylene, etc.), one or more metals (e.g., aluminum, carbon steel, stainless steel, tin, brass, etc.), one or more composite materials (e.g., a paper composite, reinforced plastics, etc.), and/or one or more organic materials (e.g., paper, wood, card stock, etc.). Example implementations of the side panels 108, 110 are described below in additional detail in FIGS. 3-11.

In the illustrated example of FIG. 1, the deployed horizontal length 114 of the collapsible storage container 100 represents the distance between an example first exterior face 118A of the front panel 104 and an example second exterior face 118B of the back panel 108B. In the illustrated example of FIG. 1, the deployed horizontal length 114 is based on the length of the side panels 108, 110 in the deployed position 102, the thickness of the front panel 104, and the thickness of the back panel 106.

Figure 2:
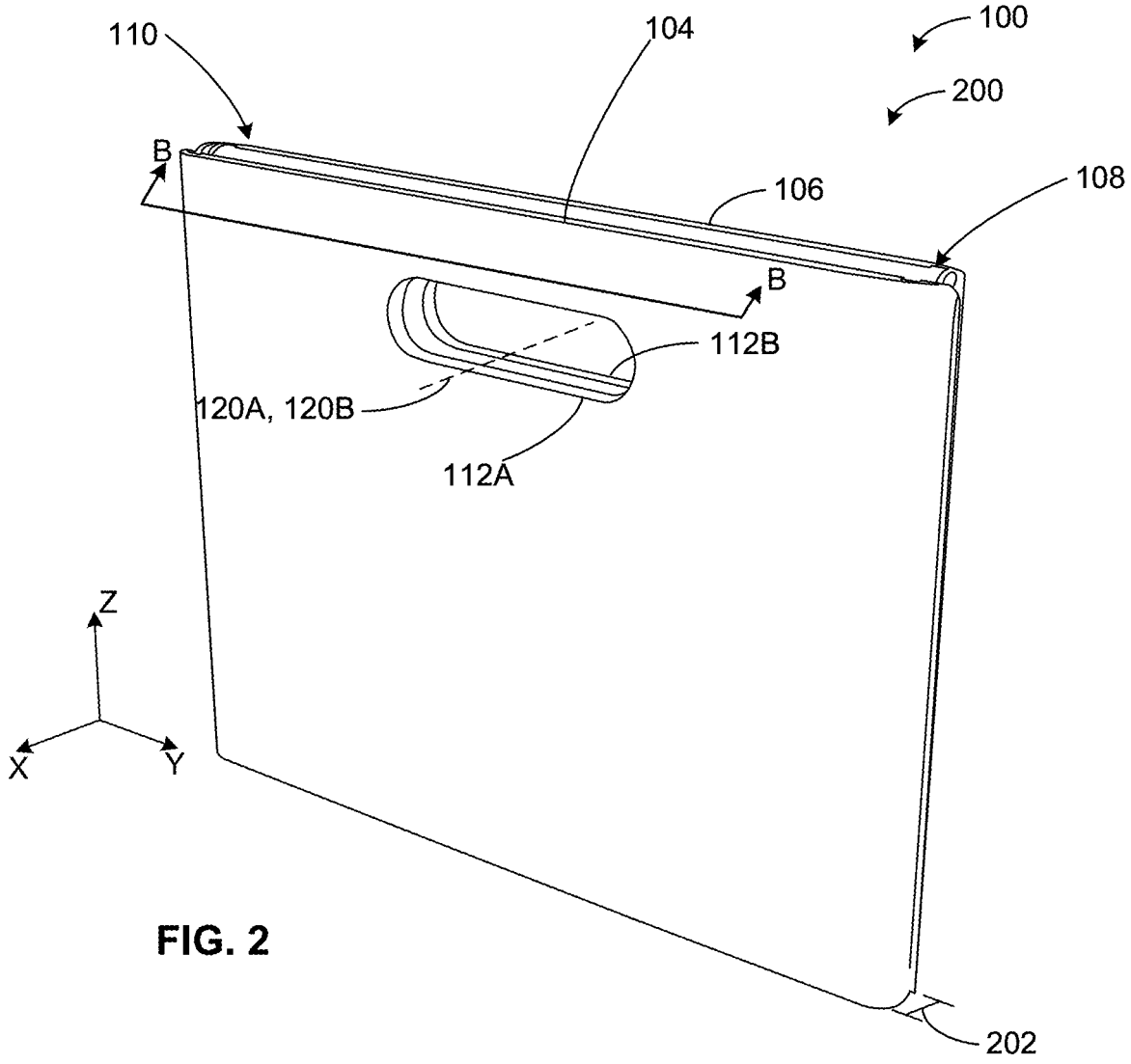
FIG. 2 is a perspective front view of the collapsible storage container of FIG. 1 in a collapsed position.

FIG. 2 is a perspective front view of the collapsible storage container 100 of FIG. 1 in an example retracted or collapsed position 200. In the illustrated example of FIG. 2, the collapsible storage container 100 has an example collapsed horizontal length 202 in the collapsed position 200. The collapsed position 200 significantly reduces the volume of the collapsible storage container 100, which can make the collapsible storage container 100 easier to transport and/or store when not containing items.

In the illustrated example of FIG. 2, the side panels 108, 110 are folded inward (e.g., toward the center of the collapsible storage container 100, etc.), such that the side panels 108, 110 are parallel to the front panel 104 and the rear panel 106. In some examples, a bottom panel (not illustrated in FIG. 2) of the collapsible storage container 100 is folded upward from a position perpendicular to the panels 104, 106, 108, 110, to a position parallel to the panels 104, 106, 108, 110. The bottom panel of the collapsible storage container 100 and the folding thereof are described below in conjunction with FIGS. 10 and 11. Example operations for moving the collapsible storage container 100 from the deployed position to the collapsed position 200 are described below in conjunction with FIG. 15. Example operations for moving the collapsible storage container 100 from the collapsed position 200 to deployed position 102 is described below in conjunction with FIG. 16.

In the illustrated example of FIG. 2, the centerline axes 120A, 120B of the handles 112A, 112B are colinear. Accordingly, the centerline axes 120A, 120B of the handles are colinear in both the deployed position 102 and the collapsed position 200. In other examples, the centerline axes 120A, 120B can have any other suitable spatial relationship.

In the illustrated example of FIG. 2, the collapsed horizontal length 202 of the collapsible storage container 100 represents the distance between the first exterior face 118A of the front panel 104 and the second exterior face 118B of the back panel 108B in the collapsed position 200. In the illustrated example of FIG. 1, the deployed horizontal length 202 is based on the thickness of the side panels 108, 110, the thickness of the front panel 104, the thickness of the back panel 106, the thickness of the bottom panel (not illustrated) of the collapsible storage container 100. The collapsed horizontal length 202 is significantly less than the deployed horizontal length 114. In the illustrated examples of FIGS. 1 and 2, the ratio of the deployed horizontal length 114 and the collapsed horizontal length 202 is approximately 5.7. In other examples, the ratio of the deployed horizontal length 114 and the collapsed horizontal length 202 can be any other suitable value (e.g., a value between 4 and 20, etc.).

Figure 3:
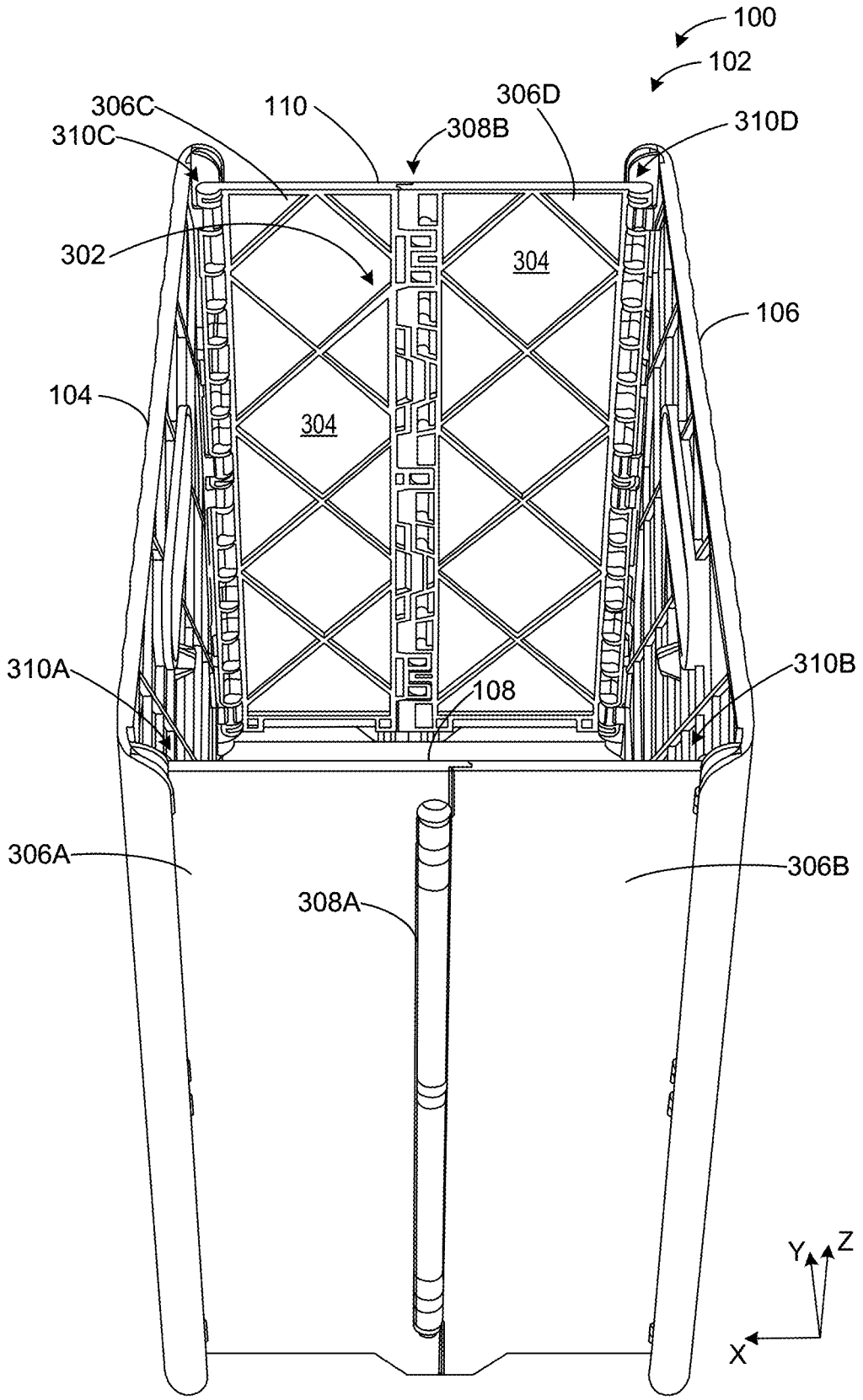
FIG. 3 is a perspective side view of the collapsible storage container of FIGS. 1 and 2 in the deployed position.

FIG. 3 is a perspective side view of the collapsible storage container 100 of FIGS. 1 and 2 in the deployed position 102. In the illustrated example of FIG. 3, the panels 104, 106, 108, 110 of the collapsible storage container 100 define an example internal cavity 302. In the illustrated example of FIG. 3, the interior faces of the second side panel 110 have an example ridge pattern 304. In the illustrated example of FIG. 3, the first side panel 108 includes an example first side panel portion 306A and an example second side panel portion 306B, and the second side panel 110 includes an example third side panel portion 306C and an example fourth side panel portion 306D. In the illustrated example of FIG. 3, the first side panel portion 306A and the second side panel portion 306B are coupled via an example first side joint 308A, and the third side panel portion 306C and the fourth side panel portion 306D are coupled via an example second side joint 308B. In the illustrated example of FIG. 3, the first side panel portion 306A is coupled to the front panel 104 via an example first corner joint 310A, the second side panel portion 306B is coupled to the rear panel 106 via an example second corner joint 310B, the third side panel portion 306C is coupled to the front panel 104 via an example third corner joint 310C, and the fourth side panel portion 306D is coupled to the rear panel 106 via an example fourth corner joint 310D.

The cavity 302 is the space in the interior of the collapsible storage container 100. The cavity 302 is defined by the interior faces of the panels 104, 106, 108, 110. Items can be stored in the collapsible storage container 100 by placing them within the cavity 302. The volume of the cavity 302 depends on the lengths of the panels 104, 106, 108, 110. Accordingly, increasing the length of the panels 104, 106, 108, 110 (e.g., the length of the front panel 104 and the rear panel 106 along the lateral axis, the length of the panels 104, 106, 108, 110 along the vertical axis, the length of the side panels 108, 110 along the horizontal axis, etc.) increases the volume of the cavity 302 and the storage capacity of the collapsible storage container 100. In some examples, hanging files can be stored within the cavity 302 by hanging file folders on the top edges of the side panels 108, 110 and/or rails that may be positioned within the collapsible storage container 100. In some such examples, the side panels 108, 110 can include features that facilitate the disposition of the handing file folders.

The ridge pattern 304 include structures formed on the interior of the second side panel 110. In some examples, the ridge pattern 304 increases the rigidity (e.g., stiffens, etc.) of the second side panel and decreases the likelihood of damage to the collapsible storage container 100 from impacts and/or punctures. In the illustrated example of FIG. 3, the ridges of the ridge pattern 304 are diamond-shaped. In other examples, the ridge pattern 304 can have any other suitable shape (e.g., another polygon, circular, a plurality of depressed and/or protruding seams, etc.). In the illustrated examples depicted in FIGS. 1-13, each of the panels 104, 106, 108, 110 includes the ridge pattern 304. In other examples, the ridge pattern 304 can be absent and the interior faces of some or all of the panels 104, 106, 108, 110 can be smooth.

The side panel portions 306A, 306B, 306C, 306D are discrete portions of the side panels 108, 110. In the illustrated example of FIG. 3, when the collapsible storage container 100 is in the deployed position 102, the first side panel 108 is in a substantially planar position because the first side panel portion 306A and the second side panel portion 306B are substantially coplanar, and the second side panel 110 is in a substantially planar position because the third side panel portion 306C and the fourth side panel portion 306D are substantially coplanar. In some examples, the side panel portions 306A, 306B, 306C, 306D include features that lock the first side panel portion 306A and the second side panel portion 306B in a colinear position, and the third side panel portion 306C and the fourth side panel portion 306D in a colinear position when the collapsible storage container 100 is in the deployed position 102. An example implementation of such features is described below in conjunction with FIG. 9.

The side joints 308A, 308B permit the side panels 108, 110 to rotate inward and the collapsible storage container 100 to move between the deployed position 102 and the collapsed position 200. The first side joint 308A is formed via features of the first side panel portion 306A and the second side panel portion 306B. The second side joint 308B is formed via features of the third side panel portion 306C and the fourth side panel portion 306D. In the illustrated example of FIG. 3, some of the features of the side panel portions 306A, 306B, 306C, 306D that form the side joints 308A, 308B extend from the exterior faces of the side panel portions 306A, 306B, 306C, 306D, which causes the side joints 308A, 308B to extend from the exterior faces of the side panel portions 306A, 306B, 306C, 306D. In the illustrated example of FIG. 3, the side joints 308A, 308B are piano hinges. In other examples, the side joints 308A, 308B can be implemented by any other suitable type of hinge and/or joint.

The corner joints 310A, 310B, 310C, 310D permit the side panel portions 306A, 306B, 306C, 306D to rotate towards corresponding ones of the front panel 104 and rear panel 106. In some examples, when the collapsible storage container 100 is moved from the deployed position 102 to the collapsed position 200, the side joints 308A, 308B move into the interior of the cavity 302, thereby rotating the side panel portions 306A, 306B, 306C, 306D. For example, while moving the collapsible storage container 100 from the deployed position 102 to the collapsed position 200, the first side panel portion 306A rotates about the first corner joint 310A towards the front panel 104, the second side panel portion 306B rotates about the second corner joint 310B towards the rear panel 106, the third side panel portion 306C rotates about the third corner joint 310C towards the front panel 104, and the fourth side panel portion 306D rotates about the fourth corner joint 310D towards the rear panel 106. After the side panel portions 306A, 306B, 306C, 306D reach a position parallel (or substantially parallel) with the front panel 104 and the rear panel 106, the collapsible storage container 100 has reached the collapsed position 200 and can be locked therein (see FIGS. 12B and 16). The side joints 308A, 308B are described in additional detail below in conjunction with FIGS. 4A, 4B, 8A and 8B. In the illustrated example of FIG. 3, the corner joints 310A, 310B, 310C, 310D are piano hinges. In other examples, the corner joints 310A, 310B, 310C, 310D can be implemented by any other suitable type of hinge and/or joint. The corner joints 310A, 310B, 310C, 310D are described in additional detail below in conjunction with FIGS. 6 and 7.

Figure 4B:
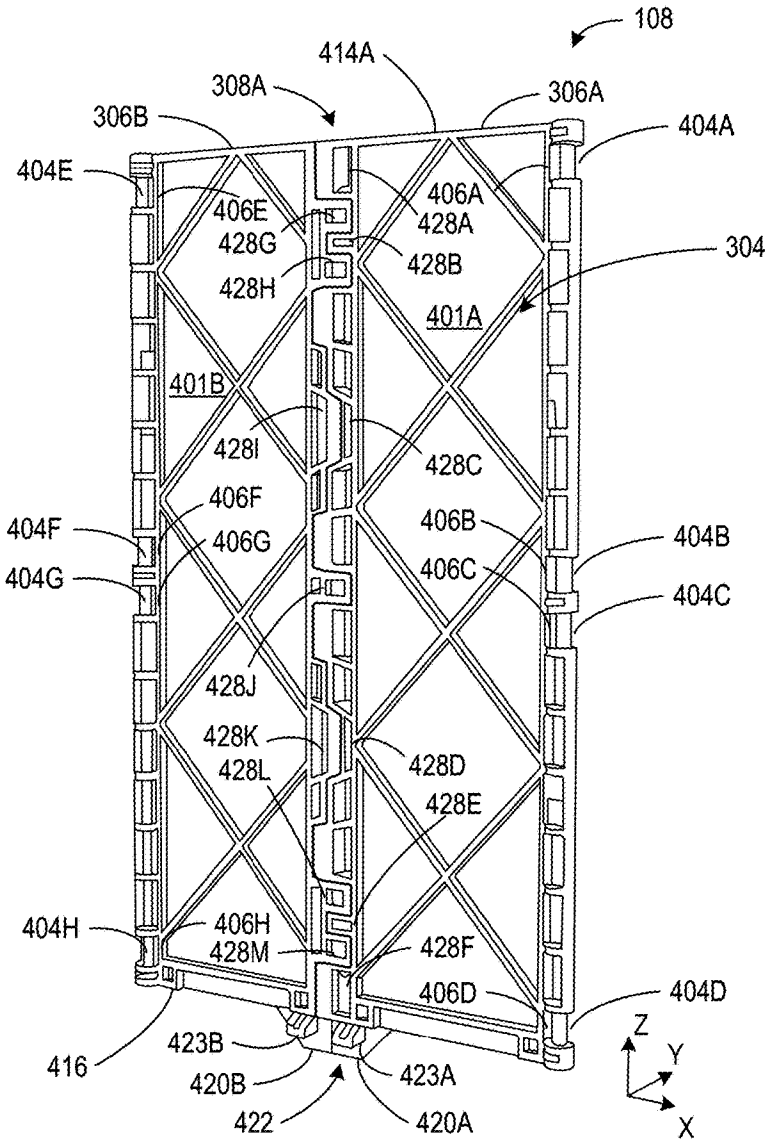
FIG. 4B is a perspective view of the rear of the first side panel of FIG. 4A.
Figure 4A:
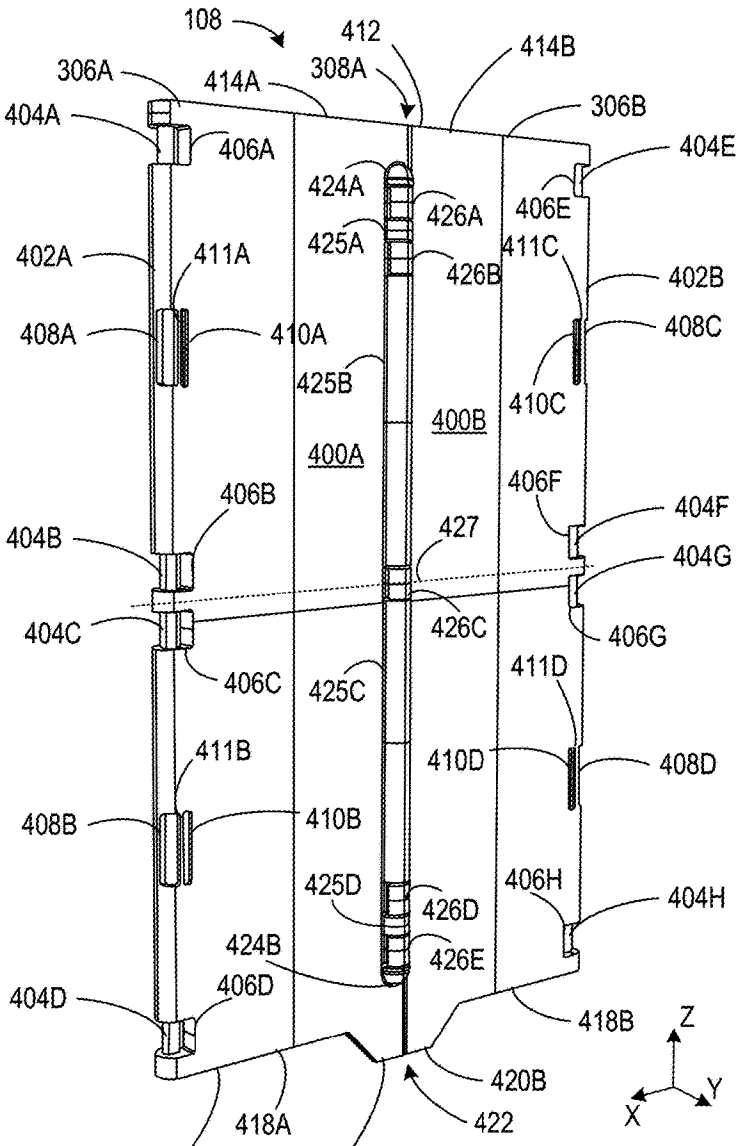
FIG. 4A is a perspective view of the front of the first side panel of the collapsible storage box of FIGS. 1-3.

FIG. 4A is a front perspective view of the first side panel 108 of the collapsible storage container 100 of FIGS. 1-3. FIG. 4B is a perspective view of the rear of the first side panel of FIG. 4A. In the illustrated example of FIG. 4A, the first side panel portion 306A of the first side panel 108 includes an example first exterior face 400A, and the second side panel portion 306B of the first side panel 108 includes an example second exterior face 400B. In the illustrated example of FIG. 4B, the first side panel portion 306A includes an example first interior face 401A on the opposing side of the first side panel 108 as the exterior face 400A and the second side panel portion 306B includes an example second interior face 401B on an opposing side of the first side panel 108 as the exterior face 400B.

In the illustrated example of FIGS. 4A and 4B, the faces 400A, 400B, 401A, 401B are generally continuous (e.g., do not include openings, etc.). In other examples, the faces 400A, 400B, 401A, 401B can include one or more openings. In some such examples, the openings in the faces 400A, 400B, 401A, 401B can be handles, aesthetic patterns, and/or features that reduce the weight of the first side panel 108 and the collapsible storage container 100. In the illustrated example of FIG. 4B, the interior faces 401A, 401B include the ridge pattern 304 of FIG. 3.

In the illustrated example of FIGS. 4A and 4B, the first side panel 108 includes an example first edge 402A and an example second edge 402B. In the illustrated example of FIGS. 4A and 4B, the edges 402A, 402B have curved (e.g., rounded, filleted, etc.) profiles that extend between respective ones of the faces 400A, 400B, 401A, 401B. In the illustrated example of FIG. 4A, the first edge 402A includes an example first pin portion 404A, an example second pin portion 404B, an example third pin portion 404C, and an example fourth pin portion 404D, which are disposed in an example first cavity 406A, an example second cavity 406B, an example third cavity 406C, and an example fourth cavity 406D, respectively. In the illustrated example of FIG. 4A, the second edge 402B includes an example fifth pin portion 404E, an example sixth pin portion 404F, an example seventh pin portion 404G, and an example eighth pin portion 404H, which are disposed in an example fifth cavity 406E, an example sixth cavity 406F, an example seventh cavity 406G, and an example eighth cavity 406H, respectively. In the illustrated example of FIG. 4A, the first edge 402A includes an example first distal slot 408A, an example second distal slot 408B, an example first proximate slot 410A, and an example second proximate slot 410B. In the illustrated example of FIG. 4A, the second edge 402B includes an example third distal slot 408C, an example fourth distal slot 408D, an example third proximate slot 410C, and an example fourth distal slot 410D.

The pin portions 404A, 404B, 404C, 404D and the slots 408A, 408B, 410A, 410B are features that permit the first edge 402A to couple with the front panel 104 to form the first corner joint 310A. The pin portions 404E, 404F, 404G, and 404H and the slots 408A, 408B, 410A, 410B are features that permit the second edge 402B to couple with the rear panel 106 to form the second corner joint 310B. Additionally or alternatively, the first edge 402A and the second edge 402B may include additional features that permit the formation of the first corner joint 310A and the second corner joint 310B, respectively. In some examples, some or all of the pin portions 404A, 404B, 404C, 404D, 404E, 404F, 404G, 404H, and/or the slots 408A, 408B, 408C, 408D, 410A, 410B, 410C, 410D are absent (e.g., the other coupling features are larger, the collapsible storage container 100 is smaller, etc.). The side panel portions 306C, 306D of the second side panel 110 of FIGS. 1-3 can include features similar to the pin portions 404A, 404B, 404C, 404D, 404E, 404F, 404G, 404H, and the slots 408A, 408B, 408C, 408D, 410A, 410B, 410C, 410D that enable the formation of the corner joints 310C, 310D with the panels 104, 106, respectively. In other examples, the corner joints 310C, 310D can be formed by any other suitable features of the second side panel 110 and the panels 104, 106.

In the illustrated example of FIGS. 4A and 4B, the pin portions 404A, 404B, 404C, 404D, 404E, 404F, 404G, 404H have substantially the same radial length and length along the vertical axis. An example shape and operation of the pin portions 404A, 404B, 404C, 404D, 404E, 404F, 404G, 404H can have a shape similar to the pin portions described below in conjunction with FIGS. 6A-6E. Additionally or alternatively, some or all of the pin portions 404A, 404B, 404C, 404D, 404E, 404F, 404G, 404H can be cylindrical, frustoconical, polygonal (e.g., with rounded/filleted corners, etc.) frustum-shaped, etc. In other examples, some or all of the pin portions 404A, 404B, 404C, 404D, 404E, 404F, 404G, and 404H can have different radial lengths and/or lengths along the vertical axis. In the illustrated example of FIGS. 4A and 4B, the major axes of the pin portions 404A, 404B, 404C, 404D are collinear and parallel to the vertical axis. In the illustrated example of FIGS. 4A and 4B, the major axes of the pin portions 404E, 404F, 404G, and 404H are collinear and parallel to the vertical axis. In other examples, the pin portions 404A, 404B, 404C, 404D, 404E, 404F, 404G, and 404H can have any other suitable orientation(s) and/or spatial relationship(s). In the illustrated example of FIGS. 4A and 4B, the first pin portion 404A and the fifth pin portion 404E are aligned along the horizontal axis, the second pin portion 404B and the sixth pin portion 404F are aligned along the horizontal axis, the third pin portion 404C and the seventh pin portion 404G are aligned along the horizontal axis, and the fourth pin portion 404D and the eighth pin portion 404H aligned along the horizontal axis.

The slots 408A, 408B, 408C, 408D, 410A, 410B, 410C, 410D are openings formed out on the exterior faces 400A, 400B. In the illustrated example of FIG. 4A, the proximate slots 410A, 410B, 410C, 410D have substantially the same size and shape and the distal slots 408A, 408B, 408C, 408D have substantially the same size and shape. In the illustrated example of FIG. 4A, the first distal slot 408A, the first proximate slot 410A, the third distal slot 408C, and the third proximate slot 410C are aligned along the horizontal axis and the second distal slot 408B, the second proximate slot 410B, the fourth distal slot 408D, and the fourth distal slot 408D are aligned along the horizontal axis. In the illustrated example of FIG. 4A, the first distal slots 408A and the second distal slot 408B are formed between the interface of the first edge 402A and the first exterior face 400A. In the illustrated example of FIG. 4A, the third distal slot 408C, and the fourth distal slot 408D are formed between the interface of the second edge 402B and the second exterior face 400B.

In the illustrated example of FIG. 4A, the first distal slot 408A and the first proximate slot 410A are separated by an example first wall 411A, the second distal slot 408B and the second proximate slot 410B are separated by an example second wall 411B, the third distal slot 408C and the third proximate slot 410C are separated by an example third wall 411C, and the fourth distal slot 408D and the fourth proximate slot 410D are separated by an example fourth wall 411D. In the illustrated example of FIG. 4A, the walls 411A, 411B, 411C, 411D are substantially flush with corresponding ones of the exterior faces 400A, 400B. In other examples, one or more of the walls 411A, 411B, 411C, 411D can protrude from and/or be receded from the corresponding ones of the exterior faces 400A, 400B. In other examples, the slots 408A, 408B, 408C, 408D, 410A, 410B, 410C, 410D and the walls 411A, 411B, 411C, 411D can have any suitable size(s), orientation(s), and spatial relationship(s).

The proximate slots 410A, 410B, 410C, 410D increase the rigidity of the side panel portions 306A, 306B. For example, the first proximate slot 410A decreases the amount of bending of the first side panel portion 306A between the first pin portion 404A and the second pin portion 404B, the second proximate slot 410B decreases the amount of bending of the first side panel portion 306A between the third pin portion 404C and the fourth pin portion 404D, the third proximate slot 410C decreases the amount of bending of the second side panel portion 306B between the fifth pin portion 404E and the sixth pin portion 404F, and the fourth proximate slot 410D decreases the amount of bending of the second side panel portion 306B between the seventh pin portion 404G and the eighth pin portion 404H. In some such examples, the proximate slots 410A, 410B, 410C, 410D are stoppers that prevent bending of the first side panel 108. In some examples, the proximate slots 410A, 410B, 410C, 410D can be absent.

In the illustrated example of FIGS. 4A and 4B, the first side panel 108 includes an example top edge 412. The top edge 412 includes an example first top edge portion 414A of the first side panel portion 306A and an example second top edge portion 414B of the second side panel portion 306B. In some examples, the interface between the first top edge portion 414A and the second top edge portion 414B can include features that prevent rotation of the side panel portions 306A, 306B about the first side joint 308A and lock the top edge 412 in a linear position and the top edge portions 414A, 414B in a collinear position.

In the illustrated example of FIGS. 4A and 4B, the first side panel 108 includes an example bottom edge 416. The bottom edge 416 includes an example first side panel portion bottom edge 418A of the first side panel portion 306A, an example first bottom protruding portion 420A of the first side panel portion 306A, an example second side panel portion bottom edge 418B of the second side panel portion 306B, and an example second bottom protruding portion 420B of the second side panel portion 306B.

In the illustrated example of FIGS. 4A and 4B, the bottom protruding portions 420A, 420B form an example flange 422. In the illustrated example of FIGS. 4A and 4B, the flange 422 is bisected by the first corner joint 310A, such that when the collapsible storage container 100 is in the collapsed position 200, the first bottom protruding portion 420A abuts and is aligned with the second bottom protruding portion 420B. In the illustrated example of FIG. 4B, the flange 422 includes an example first tab 423A and an example second tab 423B, which extend from the interior faces 401A, 401B, respectively, (e.g., into the cavity 302 of the collapsible storage container 100 in the deployed position 102, etc.). In some examples, the tabs 423A, 423B receive and/or support a bottom panel of the collapsible storage container 100 in the deployed position 102. In the illustrated example of FIG. 4B, the tabs 423A, 423B have a chamfered face that is adjacent to the interior faces 401A, 401B. In other examples, the tabs 423A, 423B can have any other suitable transition face with the interior faces 401A, 401B.

In the illustrated example of FIG. 4A, the first side joint 308A includes an example top portion 424A, an example bottom portion 424B, an example first spine portion 425A, an example second spine portion 425B, an example third spine portion 425C, an example fourth spine portion 425D, an example first receiving portion 426A, an example second receiving portion 426B, an example third receiving portion 426C, an example fourth receiving portion 426D, and an example fifth spine portion 426E. In the illustrated example of FIG. 4A, the top portion 424A, the bottom portion 424B, and the spine portions 425A, 425B, 425C, 425D extend (e.g., protrude, etc.) from the exterior face 400A of the first side panel portion 306A. In the illustrated example of FIG. 4, the top portion 424A, the bottom portion 424B, and the spine portions 425A, 425B, 425C, 425D are integral with the first side panel portion 306A. In other examples, some or all of the top portion 424A, the bottom portion 424B, and the spine portions 425A, 425B, 425C, 425D can be discrete parts coupled to the first side panel portion 306A. The receiving portions 426A, 426B, 426C, 426D extend (e.g., protrude, etc.) from the second exterior face 400B of the second side panel portion 306B. In the illustrated example of FIG. 4, the receiving portions 426A, 426B, 426C, 426D are integral with the second side panel portion 306B. In other examples, some or all of the receiving portions 426A, 426B, 426C, 426D can be discrete parts coupled to the second side panel portion 306B.

In the illustrated example of FIG. 4A, the third receiving portion 426C is bisected by an example horizontal centerline axis 427 (e.g., a line that bisects the first side panel 108 along the horizontal axis, etc.). In the illustrated example of FIG. 4A, the first side joint 308A is symmetrical about the horizontal centerline axis 427 of the first side panel 108 and the third receiving portion 426C. For example, the top portion 424A has substantially the same shape, size, and vertical displacement from the horizontal centerline axis 427 as the bottom portion 424B. The first spine portion 425A has substantially the same shape, size, and vertical displacement from the horizontal centerline axis 427 as the fourth spine portion 425D. The second spine portion 425B has substantially the same shape, size, and vertical displacement from the horizontal centerline axis 427 and the third receiving portion 426C as the third spine portion 425C. The first receiving portion 426A has substantially the same shape, size, and vertical displacement from the horizontal centerline axis 427 as the fifth receiving portion 426E. The second receiving portion 426B has substantially the same shape, size, and vertical displacement from the horizontal centerline axis 427 and the third receiving portion 426C as the fourth receiving portion 426D. The first side joint 308A is described in further detail below in conjunction with FIGS. 8A and 8B.

In the illustrated example of FIG. 4B, the first side panel portion 306A includes an example first lip 428A, an example second lip 428B, an example third lip 428C, an example fourth lip 428D, an example fifth lip 428E, and an example sixth lip 428F and the second side panel portion 306B includes an example eighth lip 428G, an example eighth lip 428H, an example ninth lip 428I, an example tenth lip 428J, an example eleventh lip 428K, an example twelfth lip 428L, and an example thirteenth lip 428M. In the illustrated example of FIG. 4B, the lips 428A, 428B, 428C, 428D, 428E, 428F of the first side panel portion 306A interlock with the lips 428G, 428H, 428I, 428J, 428K, 428J of the second side panel portion 306B and partially form the first side joint 308A. In some examples, the interlocking of the lips 428A, 428B, 428C, 428D, 428E, 428F, 428G, 428H, 428I, 428J, 428K, 428L, 428M lock the first side panel 108 in a linear position when the collapsible storage container 100 in the deployed position.

In the illustrated example of FIG. 4B, the first lip 428A is a rectangular member that is disposed at top of the first side panel 108 and partially forms the first top edge portion 414A. In the illustrated example of FIG. 4B, the eighth lip 428G, and the ninth lip 428H are rectangular members that abut the top face and bottom face, respectively, of the second lip 428B (e.g., the lips 428G, 428H sandwich the second lip 428B, etc.). In the illustrated example of FIG. 4B, the second lip 428B is a rectangular member.

The third lip 428C is a polygonal member that extends between the ninth lip 428H and the tenth lip 428J. In the illustrated example of FIG. 4B, the third lip 428C partially surrounds and has a complimentary profile with the ninth lip 428I. In the illustrated example of FIG. 4B, the ninth lip 428I is a polygonal member. The fourth lip 428D is a polygonal member that extends between the tenth lip 428J and the twelfth lip 428L. In the illustrated example of FIG. 4B, the third lip 428C partially surrounds and has a complimentary profile with the ninth lip 428I. In the illustrated example of FIG. 4B, the third lip 428C has substantially the same profile, size, and shape as the fourth lip 428D and the ninth lip 428I has substantially the same profile, size, and shape as the eleventh lip 428K. In other examples, the third lip 428C and the fourth lip 428D can have different profiles, sizes, and/or shapes. In other examples, the ninth lip 428I and the eleventh lip 428K can have different profiles, sizes, and/or shapes.

In the illustrated example of FIG. 4B, the tenth lip 428J is a rectangular member that is disposed in an approximate vertical center of the first side panel 108. The tenth lip 428J extends from the second interior face 401B and horizontally abuts the first interior face 401A. The tenth lip 428J vertically abuts a bottom face of the third lip 428C and a top face of the fourth lip 428D. In the illustrated example of FIG. 4B, the twelfth lip 428L and the thirteenth lip 428M are rectangular members that abut the top face and bottom face, respectively, of the fifth lip 428E (e.g., the lips 428L, 428M sandwich the fifth lip 428E, etc.). In the illustrated example of FIG. 4B, the fifth lip 428E is a rectangular member.

In the illustrated example of FIG. 4B, the configuration of the lips 428A, 428B, 428C, 428D, 428E, 428F, 428G, 428H, 428I, 428J, 428K, 428L, 428M is symmetrical about the tenth lip 428J. In other examples, the lips 428A, 428B, 428C, 428D, 428E, 428F, 428G, 428H, 428I, 428J, 428K, 428L, 428M can have any other suitable spatial relationship, shape, and/or size. In some examples, some or all of the lips 428A, 428B, 428C, 428D, 428E, 428F, 428G, 428H, 428I, 428J, 428K, 428L, 428M are absent. In some such examples, the first side joint 308A can be partially formed by any other suitable type of interface.

Though a number of pin portions (e.g., the pin portions 404A, 404B, 404C, 404D, 404E, 404F, 404G, 404H, etc.), cavities (e.g., the cavities 406A, 406B, 406C, 406D, 406E, 406F, 406G, 406H, etc.), slots (e.g., the slots 408A, 408B, 408C, 408D, 410A, 410B, 410C, 410D, etc.) walls (e.g., the walls 411A, 411B, 411C, 411D, etc.), edge portions (e.g., the top edge portions 414A, 414B, etc.), protruding portions (e.g., the protruding portions 420A, 420B, etc.) flanges (e.g., the flange 422, etc.), tabs (e.g., the tabs 423A, 423B, etc.), top portions (e.g., the top portion 424A, etc.), bottom portions (e.g., the bottom portion 424B, etc.), spine portions (e.g., the spine portions 425A, 425B, 425C, 425D, etc.), receiving portions (e.g., the receiving portions 426A, 426B, 426C, 426D, etc.), and lips (e.g., the lips 428A, 428B, 428C, 428D, 428E, 428F, 428G, 428H, 428I, 428J, 428K, 428L, 428M, etc.) are illustrated in the example of FIGS. 4A and 4B, in other examples, there may be other numbers (e.g., more or fewer) of the pin portions, cavities, slots, walls, edge portions, protruding portions, flanges, tabs, top portions, bottom portions, spine portions, receiving portions, and/or lips.

Figure 5:
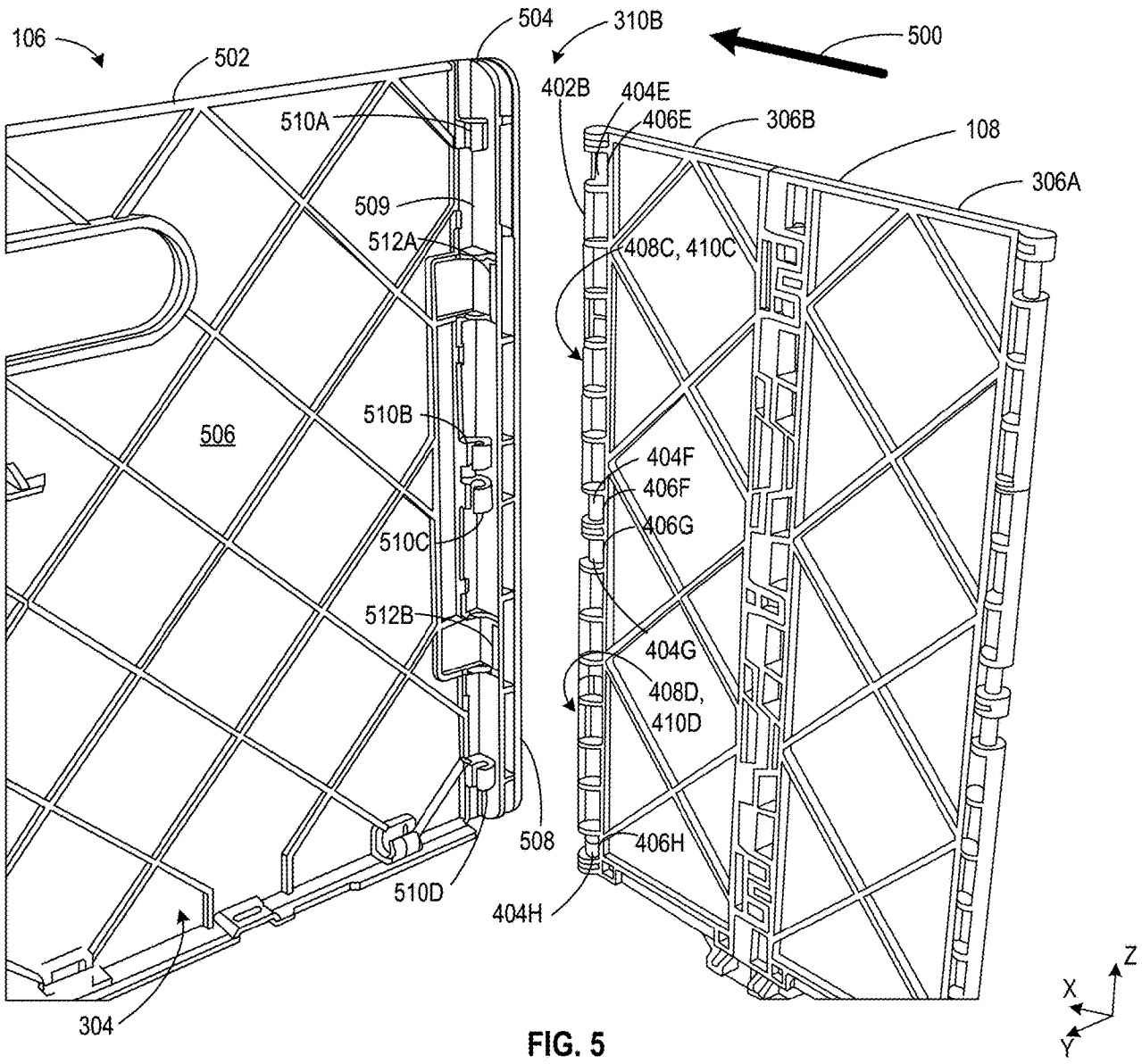
FIG. 5 is a perspective view depicting the coupling of a rear panel of the collapsible storage box of FIGS. 1-3 to the side panel of FIGS. 4A and 4B.

FIG. 5 is a perspective view depicting an example coupling 500 of the rear panel 106 of FIG. 1 to the first side panel 108 of FIGS. 4A and 4B to form the second corner joint 310B of FIG. 3B. In the illustrated example of FIG. 5, the front panel 104 includes an example planar portion 502 and an example end portion 504. The planar portion 502 includes an example interior face 506. In the illustrated example of FIG. 5, the end portion 504 includes an example lip 508 and the end portion 504 includes an example interior face 506. In the illustrated example of FIG. 5, the end portion 504 of the rear panel 106 includes an example first receiving portion 510A, an example second receiving portion 510B, an example third receiving portion 510C, an example fourth receiving portion 510D, an example first boss 512A, and an example second boss 512B. While the coupling 500 of FIG. 5 describes the coupling of the rear panel 106 with the first side panel 108 to form the second corner joint 310B of FIG. 3, the accompanying description can be similarly applied to the coupling of the front panel 104 to the first side panel 108 to form the first corner joint 310A, the coupling of the front panel 104 to the second side panel 110 to form the third corner joint 310C, and the coupling of the rear panel 106 to the second side panel 110 to form the fourth corner joint 310D.

The planar portion 502 (e.g., the body of the rear panel 106, the main body of the rear panel 106, etc.) is disposed in a planar member of the rear panel 106 disposed in a plane parallel to the vertical-lateral plane and perpendicular with the end portion 504. In the illustrated example of FIG. 5, the interior of the planar portion 502 includes the ridge pattern 304. In other examples, the planar portion 502 can have a different ridge pattern or no ridge pattern.

In the illustrated example of FIG. 5, the planar portion 502 and the end portion 504 are integral components (e.g., an integral component formed via injection molding, via stamping, etc.). In other examples, the planar portion 502 and the end portion 504 can be discrete components coupled together via one or more fasteners, one or more welds, one or more chemical adhesives, one or more press fits, and/or one or more shrink fits, etc. In some such examples, the planar portion 502 and the end portion 504 are rigidly coupled (e.g., unable to rotate and translate relative to one another, etc.).

In the illustrated example of FIG. 5, the end portion 504 includes an example lip 508 that is disposed in a plane perpendicular to the vertical-horizontal plane, the planar portion 502, and the parallel to the first side panel 108 in the deployed position 102 of FIG. 1. After the coupling 500, the lip 508 partially covers (e.g., overlaps, etc.) the second exterior face 400B (not illustrated in FIG. 5) of the second side panel portion 306B. The lip 508 prevents the rotation of the second corner joint 310B in a counterclockwise direction from the deployed position 102 (e.g., the lip 508 prevents the first side panel 108 and the second side panel portion 306B from rotating outward and away from the interior face 506, etc.).

The interior of the end portion 504 includes an example trough 509, which is a curved (e.g., filleted, etc.) transition portion between the lip 508 and the planar portion 502. In the illustrated example of FIG. 5, the curvature of the trough 509 of the end portion 504 is complementary with the curvature of the second edge 402B of the first side panel 108. The complimentary curvature of the trough 509 and the second edge 402B permit the first side panel 108 to rotate relative to the rear panel 106 during the rotation of the second corner joint 310B. In the illustrated example of FIG. 5, the trough 509 includes a concave curvature that permits the convex curvature of the second edge 402B to be received thereby. In other examples, the through 509 can include a convex curvature that receives the corresponding concave curvature of the second edge 402B. In some examples, the second edge 402B abuts the through 509 after the coupling 500 of the rear panel 106 and the first side panel 108. In other examples, a gap can be present between the second edge 402B and the through 509 after the coupling 500.

In some examples, the rear panel 106 includes another example end portion (not illustrated in FIG. 5) on an opposite side of the planar portion 502 as the end portion 504. In some such examples, the other end portion of the rear panel 106 can be substantially similar to the end portion 504. In some such examples, the rear panel 106 can be symmetrical about a vertical line bisecting the rear panel 106 (e.g., the other end portion is mirrored with respect to the end portion 504, etc.). In some examples, the front panel 104 of FIG. 1 can include a planar portion similar to the planar portion 502 and end portions similar to the end portion 504.

The receiving portions 510A, 510B, 510C, 510D include features to receive the pin portions 404E, 404F, 404G, 404H. In the illustrated example of FIG. 5, the receiving portions 510A, 510B, 510C, 510D are tube-shaped bosses extending from the trough 509. In the illustrated example of FIG. 5, the receiving portions 510A, 510B, 510C, 510D include openings that are sized to receive corresponding ones of the pin portions 404E, 404F, 404G, 404H. In some such examples, the walls of the receiving portions 510A, 510B, 510C, 510D extend into the corresponding cavities 406A, 406B, 406C, 406D.

In some examples, the pin portions 404E, 404F, 404G, 404H are slightly larger in diameter than the opening in the walls of the receiving portions 510A, 510B, 510C, 510D. In some such examples, during the coupling 500, the material of the pin portions 404E, 404F, 404G, 404H and/or the receiving portions 510A, 510B, 510C, 510D is elastically deformed during the coupling 500. After the pin portions 404E, 404F, 404G, 404H have been disposed within the receiving portions 510A, 510B, 510C, 510D and the material undeforms, the pin portion 404E, 404F, 404G, 404H is retained within the receiving portions 510A, 510B, 510C, 510D, thereby forming a press-fit connection between the rear panel 106 and the first side panel 108. An example interface between the first receiving portion 510A and the fifth pin portion 404E is described below in conjunction with FIG. 6A.

During the coupling 500, the first boss 512A forms an interface with the third distal slot 408C and the second boss 512B forms an interface with the fourth distal slot 408D. In some examples, the bosses 512A, 512B are disposed within the distal slots 408C, 408D when the collapsible storage container 100 is in the deployed position 102. In some examples, the interface between the bosses 512A, 512B increases the strength of the second corner joint 310B in the deployed position 102. In some examples, the bosses 512A, 512B and/or the distal slots 408C, 408D can be absent.

Though a number of receiving portions (e.g., the receiving portions 510A, 510B, 510C, 510D, etc.) and bosses (e.g., the bosses 512A, 512B, etc.) are illustrated in the example of FIG. 5, in other examples, there may be other numbers (e.g., more or fewer) of receiving portions and/or bosses.

Figure 6A:
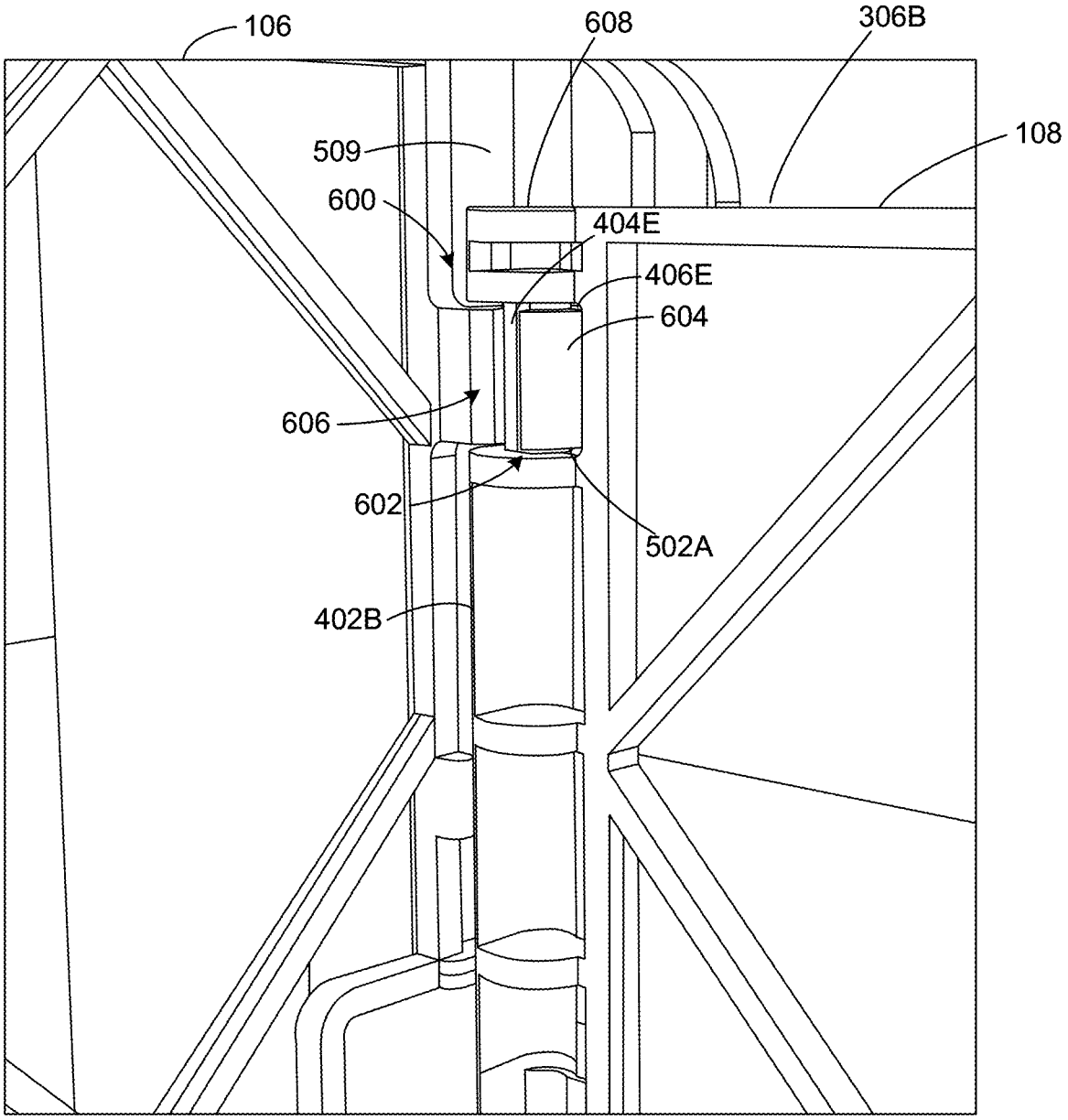
FIG. 6A is a detail view of a coupling between the rear panel and the side panel of FIG. 5.

FIG. 6A is a detail view of an example interface 600 between the first receiving portion 510A of FIG. 5 and the fifth pin portion 404E of FIGS. 4 and 5. In the illustrated example of FIG. 6A, the interface 600 is formed by the placement of the fifth pin portion 404E within an example hole 602 of the first receiving portion 510A and the extension of an example outer wall 604 of the first receiving portion 510A through the cavity 406E of the first side panel 108. During the coupling 500, the fifth pin portion 404E is pressed into through an example opening 606. As described above, the diameter of the fifth pin portion 404E is slightly larger than the width of the opening 606. When force is applied during the coupling 500, the fifth pin portion 404E and/or the outer wall 604 elastically deforms until the fifth pin portion 404E is deposited into the hole 602, thereby forming the interface 600.

In the illustrated example of FIG. 6A, the interior of the outer wall 604 (e.g., the area defining the hole 602, etc.) is curved, thereby permitting the rotation of the fifth pin portion 404E within the interface 600. In the illustrated example of FIG. 6A, the second edge 402B further includes an example top cap 608 disposed above the fifth pin portion 404E. In the illustrated example of FIG. 6A, the top cap 608 of the second edge 402B, like other portions of the edge 402B (e.g., the portions not associated with pin portions 404E, 404F, 404G, 404E and/or the cavities 406E, 406F, 406G, 406E, etc.), has a complementary curve with the trough 509 of the rear panel 106. While the illustrated example of FIG. 6A describes the interface 600 between the fifth pin portion 404E and the first receiving portion 502A, the associated description can be similarly applied to the interfaces between the pin portions 404F, 404G, 404E and the respective ones of the receiving portions 502B, 502C, 502D and/or other similar interfaces associated with the corner joints 310A, 310B, 310D.

Figure 6B:
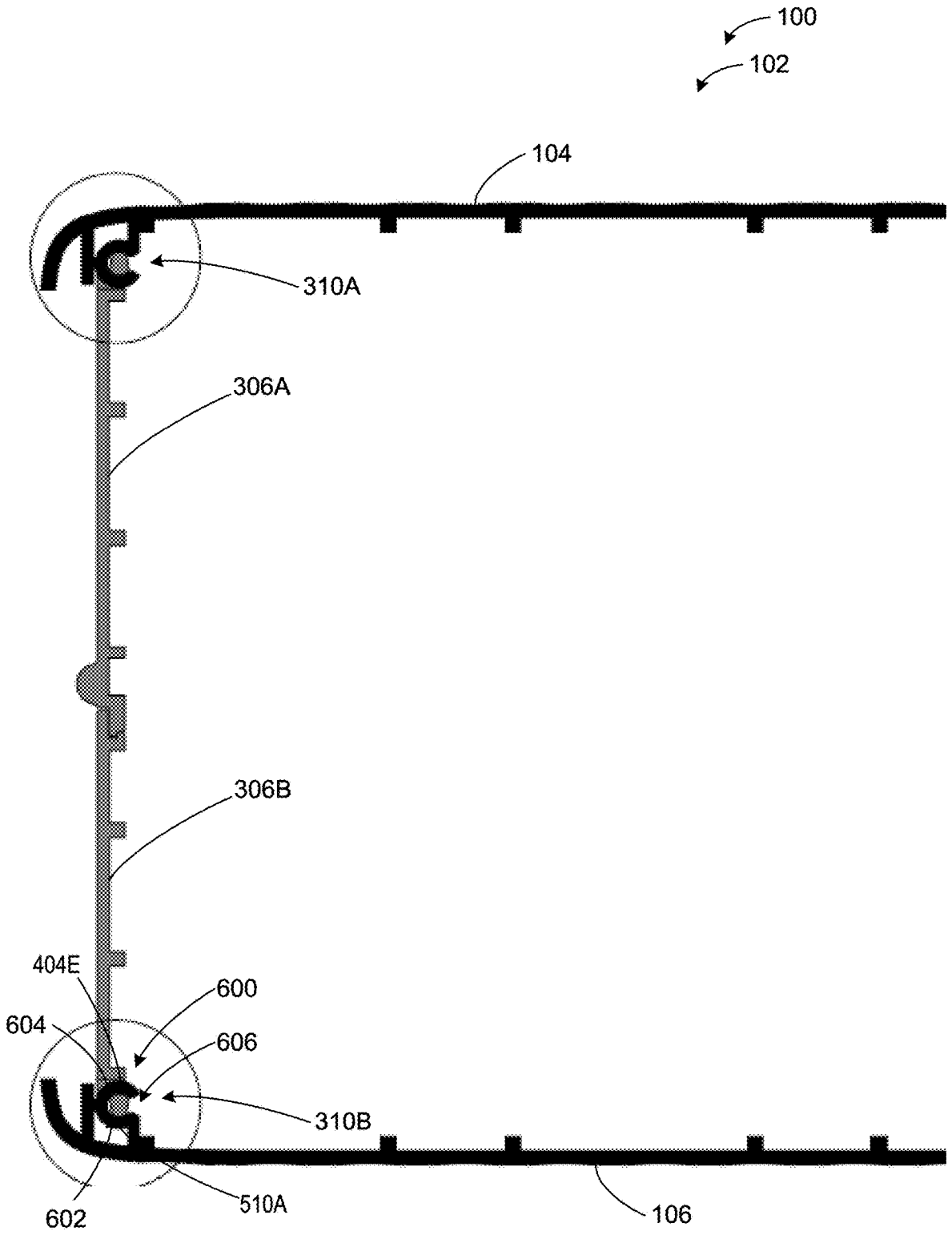
FIG. 6B is a partial cross-sectional view depicting the coupling of the first side panel, the front panel, and the rear panel in the deployed position of FIG. 1.

FIG. 6B is a partial cross-sectional view of the first side panel 108, the front panel 104, and the rear panel 106 in the deployed position 102 taken along the A-A line of FIG. 1. In the illustrated example of FIG. 6B, the fifth pin portion 404E is shaped like a frustum with rounded ends (e.g., a trapezoidal prism with rounded ends, etc.). The shape of the fifth pin portion 404E inhibits (e.g., frustrates, prevents, hinders, etc.) the interface 600 from releasing while the collapsible storage container 100 is in the deployed position 102. Particularly, in the deployed position 102, the orientation of the fifth pin portion 404E within the hole 602 increases the amount of force required to elastically deform the fifth pin portion 404E and/or the wall 604 enough to enable the fifth pin portion 404E to slide out of the hole 602. In some examples, the fifth pin portion 404E and the other pin portions associated with the corner joints of the collapsible storage container 100 (e.g., the corner joints 310A, 310B, 310C, 310D, etc.) can have a same shape as the fifth pin portion 404E. In other examples, the other pin portions of the corner joints 310A, 310B, 310C, 310D can have any other suitable shape(s). The example orientation of the fifth pin portion 404E within the first receiving portion 510A in the deployed position 102 is described in additional detail below in conjunction with FIG. 6E. In some examples, the interfaces of the first corner joint 310A, the third corner joint 310C, and the fourth corner joint 310D and the other interfaces of the second corner joint 310B can be implemented in a manner similar to the interface 600.

Figure 6C:
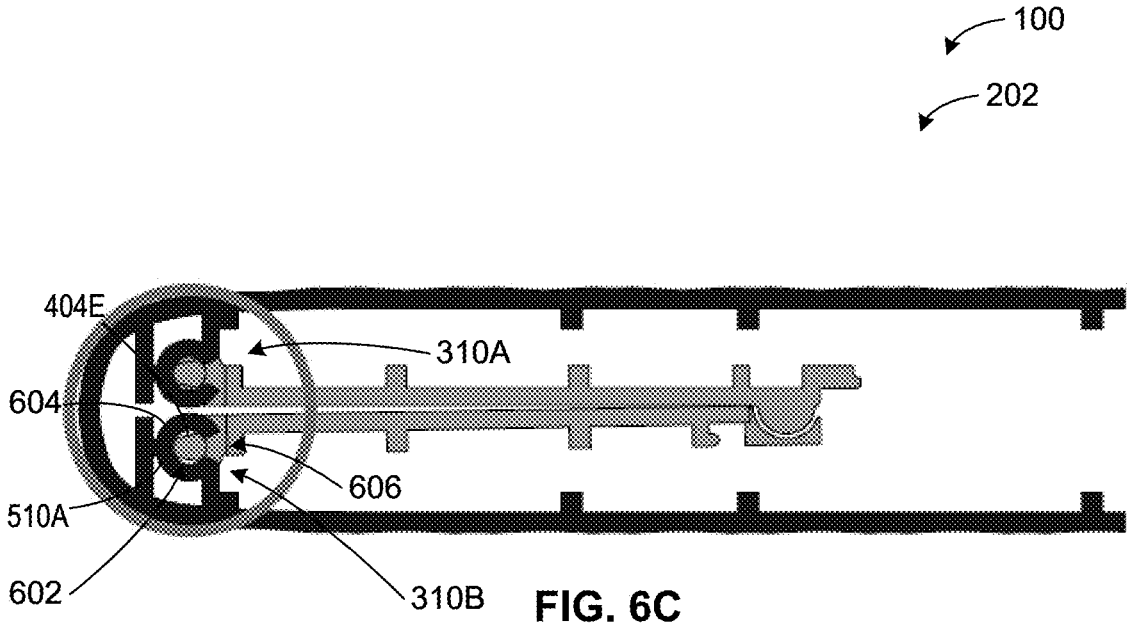
FIG. 6C is a partial cross-sectional view depicting the coupling of the first side panel, the front panel, and the rear panel in the collapsed position of FIG. 1.

FIG. 6C is a partial cross-sectional view of the first side panel 108, the front panel 104, and the rear panel 106 in the collapsed position 200 taken along the B-B line of FIG. 2. In the illustrated example of FIGS. 4A-6B, the fifth pin portion 404E is rigidly coupled to the second side panel portion 306B. Accordingly, as the second side panel portion 306B rotates approximately 90 degrees From a position substantially perpendicular to the rear panel 106 in the deployed position 102 to a position substantially parallel to the rear panel 106 in the collapsed position 200, the orientation of the fifth pin portion 404E rotates approximately 90 degrees within the hole 602. In the illustrated example of FIG. 6C, the shape and orientation of the fifth pin portion 404E decreases the amount of force required to release the interface 600 while the collapsible storage container 100 is in the collapsed position 200 (e.g., relative to the amount of force required to release the interface in the deployed position 102, etc.). The example orientation of the fifth pin portion 404E within the first receiving portion 510A in the collapsed position 200 is described in additional detail below in conjunction with FIG. 6D.

Figure 6D:
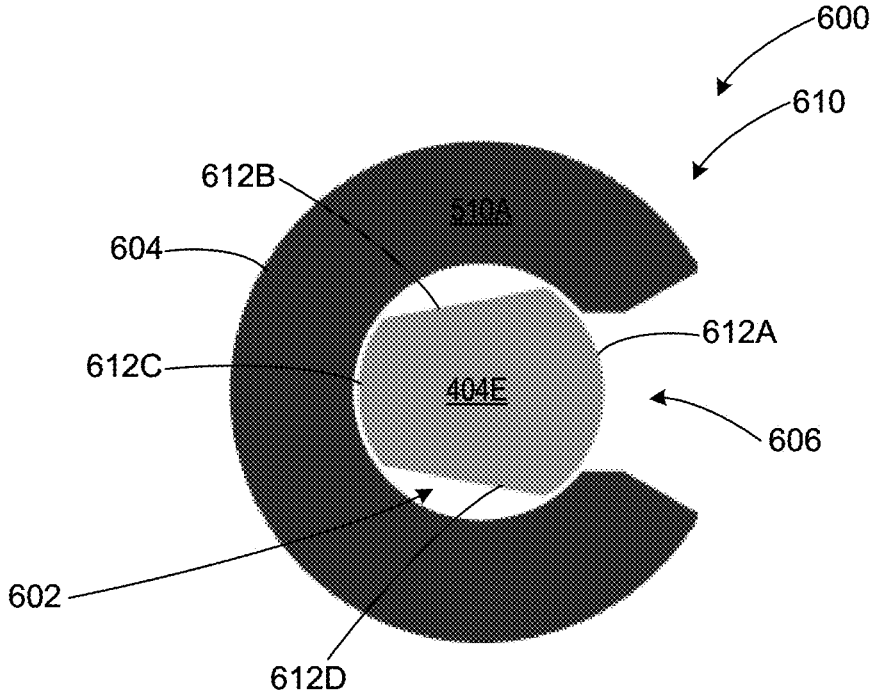
FIG. 6D is a detail view of the coupling between the rear panel and the side panel of FIG. 5 in the collapsed position of FIGS. 1 and 6C.

FIG. 6D is a detail view of the interface 600 in the collapsed position 200 of FIGS. 2 and 6C. In the illustrated example of FIG. 6D, the fifth pin portion 404E is in an example first orientation 610, corresponding to the collapsed position 200 of FIG. 6B. In the illustrated example of FIG. 6B, the fifth pin portion 404E has an example first side 612A, an example second side 612B, an example third side 612C, and an example fourth side 612D. In the illustrated example of FIG. 6D, the first side 612A and the third side 612C are curved (e.g., filleted, rounded, etc.) and the second side 612B and the fourth side 612D are straight (e.g., planar walls, etc.). In the illustrated example of FIG. 6D, the second side 612B and the fourth side 612D are not disposed in parallel planes and have a lower displacement at the ends adjacent to the third side 612C than the ends adjacent to the first side 612A. Accordingly, the first side 612A is longer than the third side 612C. In the first orientation 610 of FIG. 6D, the first side 612A is adjacent to the opening 606. In the illustrated example of FIG. 6D, the rounded sides 612A, 612C permit the pin portion 404E to rotate within the hole 602, thereby enabling the first side panel 108 to rotate about the first corner joint 310A.

To remove the fifth pin portion 404 from the receiving portion 510A and release the interface 600, a force can be applied to elastically deform the first side 612A and/or the wall 604 until the fifth pin portion 404E slides out of the hole 602 along the edges of the first side 612A and the sides 612B, 612D. The curvature of the fifth pin portion 404E reduces the amount of elastic deformation for the fifth pin portion 404E to slide out of the opening 606. Similarly, to insert the fifth pin portion 404E into the hole 602, the third side 612C is pressed into the opening 606. In the illustrated example of FIG. 6D, the third side 612C is approximately equal in size as the opening 606. Accordingly, during the insertion of the pin portion 404E, the shape of the pin portion 404E guides the pin portion 404E into the hole 602 via the sliding of the second side 612B and the fourth side 612D along the sides of the opening 606 and reduces the amount of force to deform the pin portion 404E and/or the receiving portion 510A.

Figure 6E:
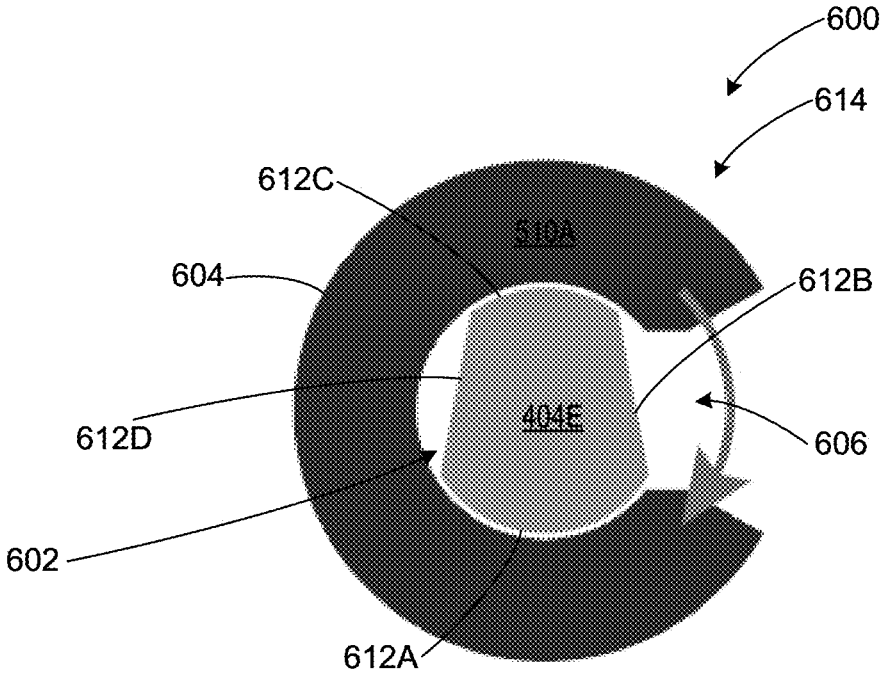
FIG. 6E is a detail view of the coupling between the rear panel and the side panel of FIG. 5 in the deployed position of FIGS. 1 and 6B.

FIG. 6E is a detail view of the interface 600 in the deployed position 102 of FIGS. 1 and 6B. In the illustrated example of FIG. 6D, the fifth pin portion 404E is in an example second orientation 614, corresponding to the deployed position 102 of FIG. 6B. In the illustrated example of FIG. 6E, the second side 612B is adjacent with the opening 606. In the illustrated example of FIG. 6E, the second side 612B is straight (e.g., planar, etc.) and substantially longer than the opening 606, which increases the amount of the elastic deformation to release the interface 600 when the fifth pin portion 404E is in the second orientation 614. Accordingly, the second orientation 614 inhibits the release of the interface 600, which increases the strength of the second corner joint 310B in the deployed position 102.

Figure 7:
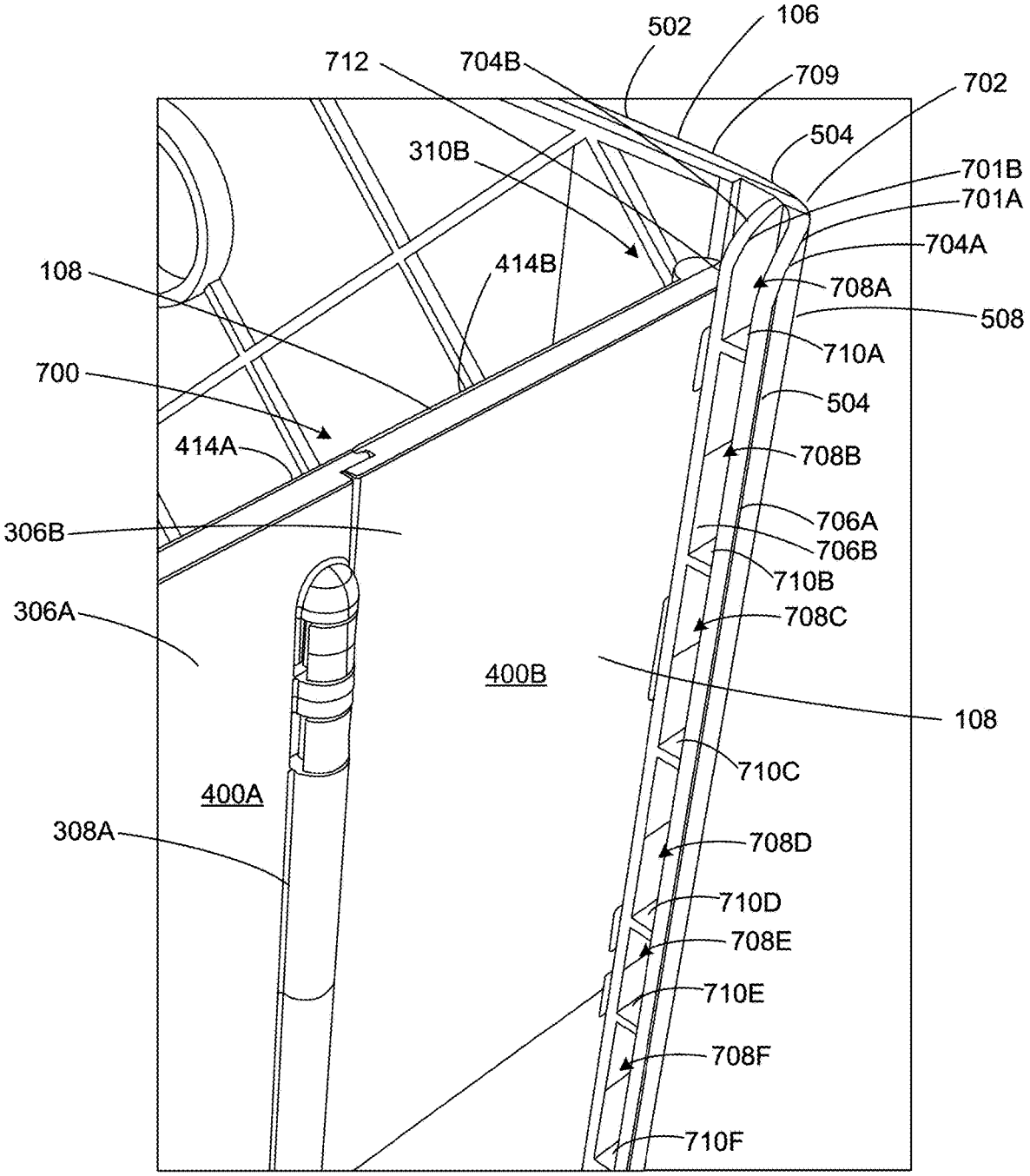
FIG. 7 is a perspective view depicting the joint between the rear panel and the side panel of FIG. 5 in the deployed position of FIG. 1.

FIG. 7 is a perspective view depicting the second corner joint 310B between the rear panel 106 and the first side panel 108 in the deployed position 102 of FIG. 1. In the illustrated example of FIG. 7, the first side panel 108 includes an example interface 700 between the first side panel portion 306A and the second side panel portion 306B. In the illustrated example of FIG. 7, in the deployed position 102, the interface 700 prevents the rotation of the side panel portions 306A, 306B about the first side joint 308A. An example top view of the interface 700 is described below in conjunction with FIG. 9.

In the illustrated example of FIG. 7, the lip 508 of the end portion 504 includes an example first wall 701A and an example second wall 701B. The first wall 701A includes an example transition segment 702, an example first curved segment 704A, and an example vertical segment 706A. The second wall 701B includes an example second curved segment 704B and an example second vertical segment 706B. The example walls 701A, 701B are disposed in a plane parallel to the vertical-horizontal plane. In the illustrated example of FIG. 7, the curved segments 704A, 704B extend between an example top edge 709 of the rear panel 106 and the vertical segments 706A, 706B, respectively. In the illustrated example of FIG. 7, the walls 701A, 701B are substantially flush.

The first wall 701A and the planar portion 502 are separated by the transition segment 702. In the illustrated example of FIG. 7, the first wall 701A is integral with the planar portion 502. In the illustrated example of FIG. 7, the first wall 701A has a same thickness as the planar portion 502 and the second wall 701B has a lower thickness than the first wall 701A and the planar portion 502. In other examples, the walls 701A, 701B can have any other suitable thicknesses. The second wall 701B abuts the exterior face 400B of the second side panel portion 306B when the collapsible storage container 100 is in the deployed position 102.

In the illustrated example of FIG. 7, the first wall 701A and the second wall 701B are separated by an example first cavity 708A, an example second cavity 708B, an example third cavity 708C, an example fourth cavity 708D, an example fifth cavity 708E, and an example cavity 708F. In some examples, the cavities 708A, 708B, 708C, 708D, 708E reduce the amount of material required to manufacture the rear panel 106 and/or the lip 508. In some examples, some or all of the cavities 708A, 708B, 708C, 708D, 708E, 708F may be absent. In some such examples, the first wall 701A can abut the second wall 701B and/or be integral with the second wall 701B.

In the illustrated example of FIG. 7, the first cavity 708A is defined by the first wall 701A, the second wall 701B, an example first cross segment 710A. In the illustrated example of FIG. 7, the second cavity 708B is defined by the first wall 701A, the second wall 701B, the first cross segment 710A, and an example second cross segment 710B. In the illustrated example of FIG. 7, the third cavity 708C is defined by the first wall 701A, the second wall 701B, the second cross segment 710B, and an example third cross segment 710C. In the illustrated example of FIG. 7, the fourth cavity 708D is defined by the first wall 701A, the second wall 701B, the third cross segment 710C, and an example fourth cross segment 710D. In the illustrated example of FIG. 7, the fifth cavity 708E is defined by the first wall 701A, the second wall 701B, the fourth cross segment 710D, and an example fifth cross segment 710E. In the illustrated example of FIG. 7, the sixth cavity 708F is defined by the first wall 701A, the second wall 701B, the fifth cross segment 710E, and an example sixth cross segment 710F. The cross segments 710A, 710B, 712C, 712D, 712E, 712F structurally supports the walls 701A, 701B and the stiffens rear panel 106. In the illustrated example of FIG. 7, the cross segments 710A, 710B, 710C, 710D, 710E, 710F are parallel to the horizontal lateral plane, perpendicular to planar portion 502 and perpendicular to the planes defined by the walls 701A, 701B. In other examples, the cross segments can have any other suitable orientations(s) (e.g., disposed at an angle relative to the horizontal lateral plane, etc.). In some examples, some or all of the cross segments 710A, 710B, 710C, 710D, 710E, 710F can be absent. In some such examples, the area separating the first wall 701A and the second wall 701B can be empty. It should be appreciated that the example lip 508 includes more cavities and cross segments than the cavities 708A, 708B, 708C, 708D, 708E, 708F and cross segments 710A, 710B, 710C, 710D, 710E, 710F depicted in FIG. 7 (e.g., extending to the bottom of the lip 508, etc.).

Figure 11A:
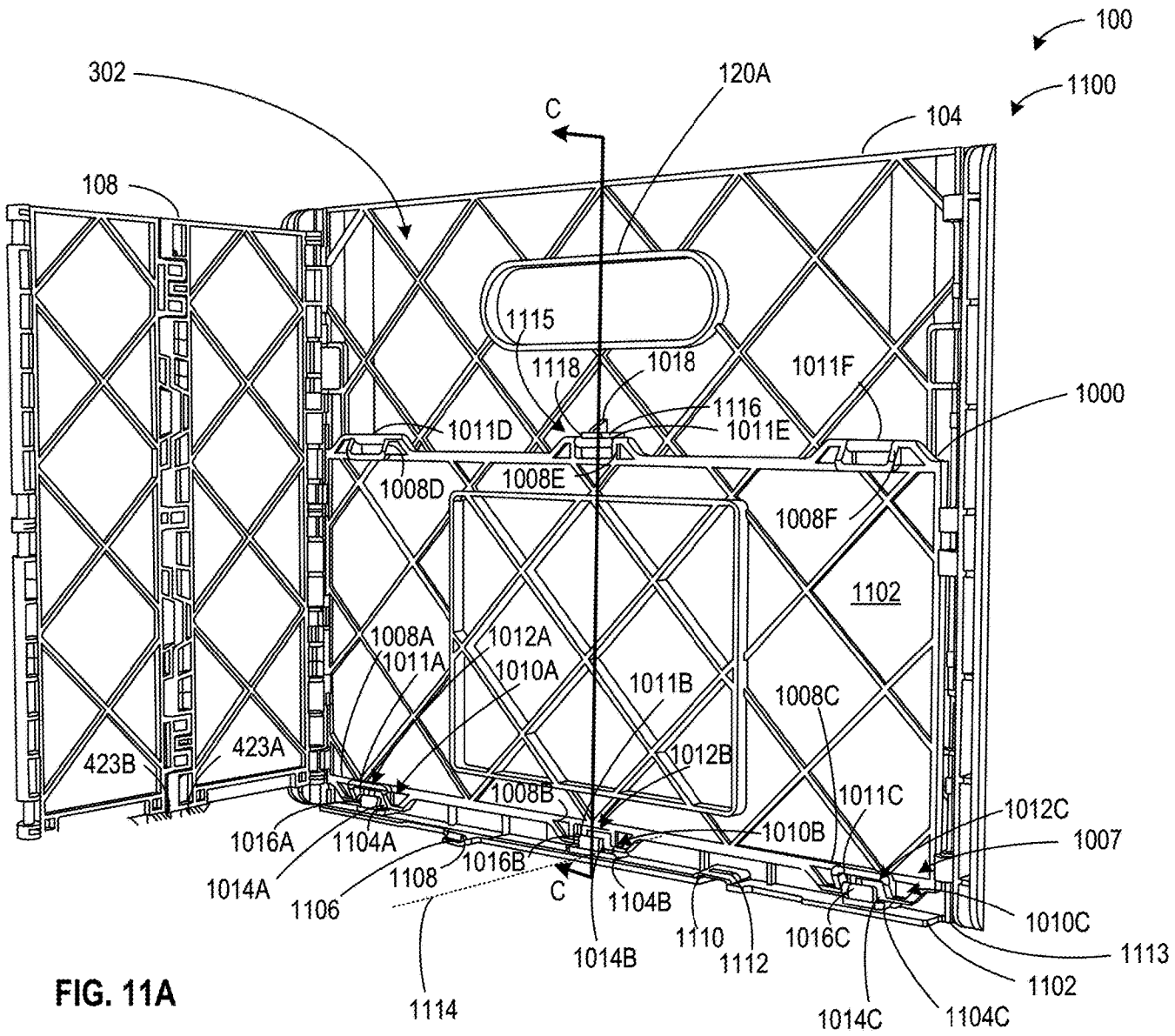
FIG. 11A is a perspective view of a bottom panel of the collapsible storage container of FIG. 1 in a second position.

In the deployed position 102, the lip 508 covers an example covered portion 712 of the second side panel portion 306B of the first side panel 108. In the illustrated example of FIG. 7, the covered portion 712 prevents access and impacts to the features of the third corner joint 310C (e.g., the pin portions 404E, 404F, 404G, 404F of FIG. 4, the receiving portions 510A, 510B, 510C, 510D, etc.). In some examples, the length of the covered portion 712 and the lip 508 along the horizontal axis is substantially equal to the sum of the thicknesses of the second side panel portion 306B and the bottom panel of the collapsible storage container 100 (FIG. 11A). In some such examples, when the collapsible storage container 100 is in the collapsed position 200, the walls 701A, 701B abut corresponding walls of an opposing lip of the front panel 104. The position of the opposing lips of the panels 104, 106 is described below in conjunction with FIG. 13.

Though a number of cavities (e.g., the cavities 708A, 708B, 708C, 708D, 708E, 708F, etc.) and cross segments (e.g., 710A, 710B, 710C, 710D, 710E, 710F, etc.) are illustrated in the example of FIG. 7, in other examples, there may be other numbers (e.g., more or fewer) of cavities and/or cross segments.

Figure 8A:
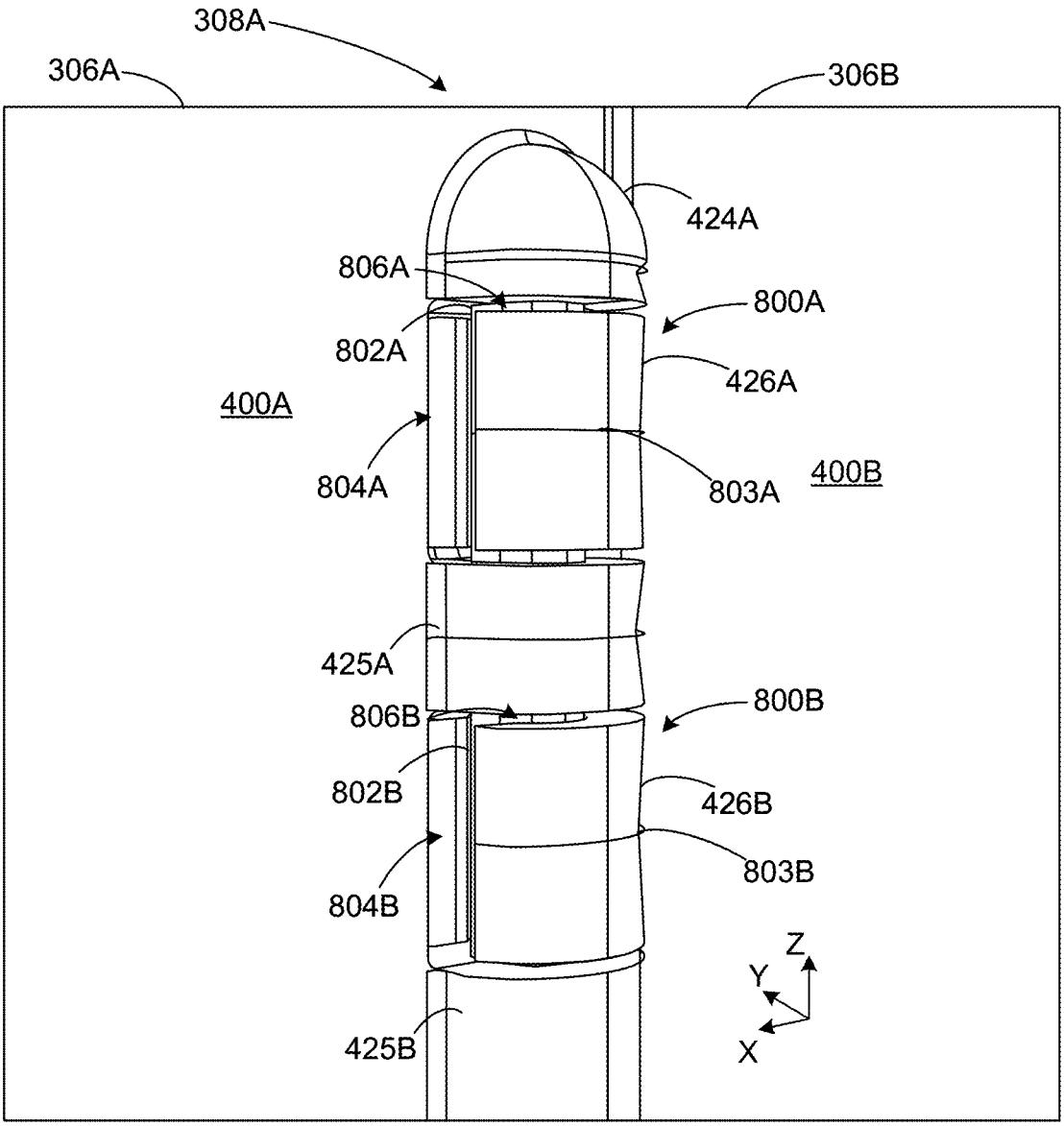
FIG. 8A is a detail view of a top of the interface between the side panel portions of FIGS. 4A and 4B.
Figure 8B:
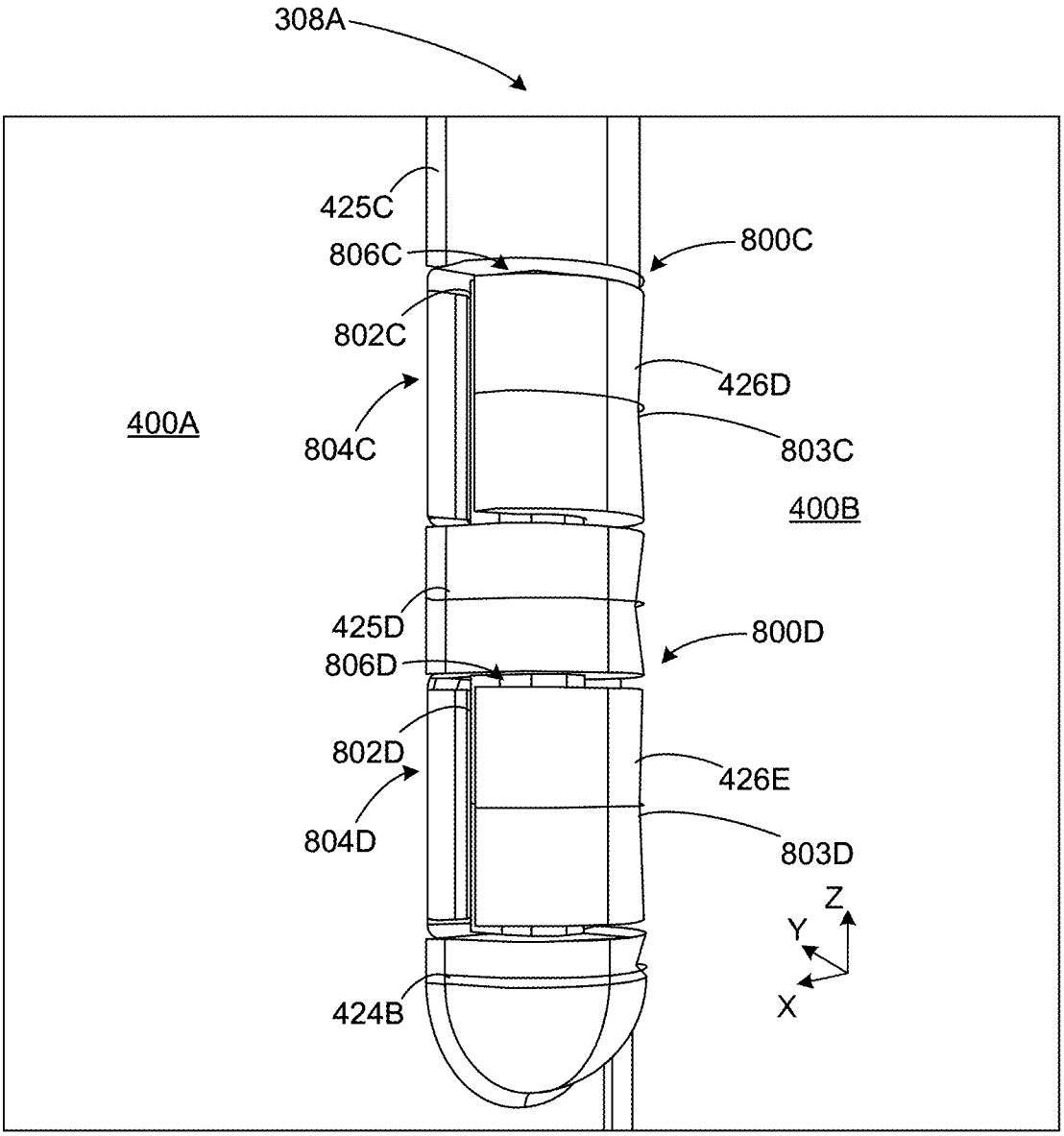
FIG. 8B is a detail view of a bottom of the interface between the side panel portions of FIGS. 4A and 4B.

FIG. 8A is a detail view of the top of first corner joint 310A of FIG. 4A. FIG. 8B is a detail view of the bottom of first corner joint 310A of FIG. 4A. In the illustrated example of FIGS. 8A and 8B, the first side joint 308A includes an example first interface 800A, an example second interface 800B, an example third interface 800C, and an example fourth interface 800D. In the illustrated example of FIGS. 8A and 8B, an example first pin portion 802A extends between the top portion 424A of FIG. 4A and the first spine portion 425A of FIG. 4A, an example second pin portion 802B extends between the first spine portion 425A and the second spine portion 425B of FIG. 4A, an example third pin portion 802C extends between the third spine portion 425C of FIG. 4A and the fourth spine portion 425D of FIG. 4A, an example third pin portion 802C extends between the fourth spine portion 425D and the bottom portion 424B. In the illustrated example of FIGS. 8A and 8B, the first receiving portion 426A of FIG. 4A includes an example first outer wall 803A and an example first opening 804A, the second receiving portion 426B of FIG. 4A includes an example second outer wall 803B and an example second opening 804B, the third receiving portion 426C of FIG. 4A includes an example third outer wall 803C and an example third opening 804C, and the fourth receiving portion 426D of FIG. 4A includes an example fourth outer wall 803D and an example fourth opening 804D. In the illustrated example of FIG. 6A, the outer walls 803A, 803B, 803C, 803D define an example first hole 806A, an example second hole 806B, an example third hole 806C, and an example fourth hole 806D, respectively.

The pin portions 802A, 802B, 802C, 802D have a substantially same diameter and length along the vertical axis. In some examples, the pin portions 802A, 802B, 802C, 802D can have a shape similar to the pin portions 404E described in conjunction with FIGS. 6D and 6E. Additionally or alternatively, some or all of the pin portions 802A, 802B, 802C, 802D can be cylindrical, frustoconical, polygonal (e.g., with rounded/filleted corners, etc.) frustum-shaped, etc. In other examples, some or all of the pin portions 802A, 802B, 802C, 802D can have different diameters and/or lengths along the vertical axis. In the illustrated example of FIGS. 8A and 8B, the major axes of the pin portions 802A, 802B, 802C, 802D are collinear and parallel to the vertical axis. In the illustrated examples of FIGS. 8A and 8B, the diameter(s) of the fifth pin portion 404E is slightly larger than the width of the corresponding ones of the openings 804A, 804B, 804C, 804D.

The interfaces 800A, 800B, 800C, 800D are formed by the deposition of the pin portions 802A, 802B, 802C, 802D within the holes 806A, 806B, 806C, 806D, respectively, by pressing the pin portions 802A, 802B, 802C, 802D through the openings 804A, 804B, 804C, 804D. As described above, the diameters of the pin portions 802A, 802B, 802C, 802D are slightly larger than the widths of corresponding ones of the opening 804A, 804B, 804C, 804D. When is force is applied, the pin portions 802A, 802B, 802C, 802D and/or the outer walls 803A, 803B, 803C, 803D elastically deforms until the pin portions 802A, 802B, 802C, 802D are deposited within the corresponding ones of the holes 806A, 806B, 806C, 806D, thereby forming the interfaces 800A, 800B, 800C, 800D.

While not depicted in FIGS. 8A and 8B, it should be appreciated that the third receiving portion 426C can be coupled to a pin portion extending between the second spine portion 425B and the third spine portion 425C, similar to the pin portions 802A, 802B, 802C, 802D of FIGS. 8A and 8B. In other examples, the third receiving portion 426C can be incorporated into the first corner joint 310A in a manner different than the interfaces 800A, 800B, 800C, 800D of FIGS. 8A and 8B.

Figure 9:
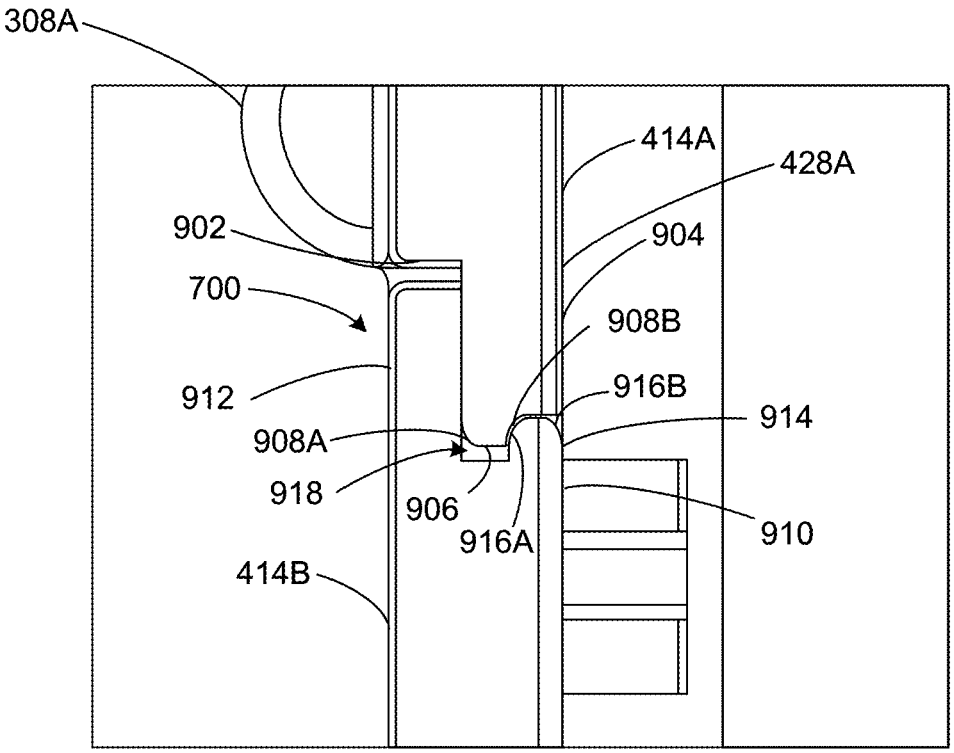
FIG. 9 is a top view of an interface between the side panel portions of FIGS. 4A and 4B.

FIG. 9 is a top detail view of the example interface 700 of FIG. 9. In the illustrated example of FIG. 9, the interface 700 is formed by the first top edge portion 414A of the first side panel portion 306A and the second top edge portion 414B. In the illustrated example of FIG. 9, the first top edge portion 414A includes an example first receded portion 902 and an example protruding portion 904, which includes an example first lip 906. In the illustrated example of FIG. 9, the first lip 906 has an example first face 908A and an example second face 908B. In the illustrated example of FIG. 9, the second top edge portion 414B includes an example second recessed portion 910 and an example second protruding portion 912, which includes an example second lip 914. In the illustrated example of FIG. 9, the second lip 914 has an example third face 916A and an example fourth face 916B. In the illustrated example of FIG. 9, the first protruding portion 904 is integral with the first lip 428A of FIG. 4. In other examples, the first protruding portion 904 and the first lip 428A can be discrete components coupled via one or more fasteners, one or more welds, one or more chemical adhesives, etc.

In the illustrated example of FIG. 9, the first face 908A, the third face 916A, and the fourth face 916B have convex curvatures and the second face 908B has a concave curvature. In the illustrated example of FIG. 9, the first face 908A and the fourth face 916B have a same curvature (e.g., both convex curves with substantially the same profile, etc.). The curvatures of the first face 908A and the fourth face 916B permit the lip 906 of the first protruding portion 904 to slide and rotate past the second lip 914, such that first lip 906 slides into the channel 918 while the collapsible storage container 100 is being articulated from the collapsed position 200 into the deployed position 102. In the illustrated example of FIG. 9, the second face 908B, and the third face 916A have complimentary curvatures. In some such examples, the complimentary curvatures of the second face 908B and the third face 916A permit the side panel portions 306A, 306B to rotate about the first side joint 308A during the movement of the collapsible storage container 100 from the deployed position 102 to the collapsed position 200 and from the collapsed position 200 to the deployed position 102. In other examples, the second face 908B has a convex curvature and the third face 916A has a concave curvature.

As described above in conjunction with FIG. 7, the interface 700 retains (e.g., locks, etc.) the side panel portions 306A, 306B in a collinear position and the first side panel 108 in a linear position when the collapsible storage container 100 is in the deployed position 102. In the illustrated example of FIG. 7, the second protruding portion 912 is received by the second recessed portion 902, and the first protruding portion 904 is received by the second recessed portion 910, such that the first lip 906 is disposed within an example channel 918 defined by the second protruding portion 912 and the second lip 914. The second lip 914 retains the first lip 906 within the channel 918, which locks the interface 700. When force is applied to the side panels portion 306A, 306B to rotate the side panels portions 306A, 306B about the first side joint 308A and move the collapsible storage container 100 from the deployed position 102 to the collapsed position 200, the second face 908B moves towards and abuts the third face 916A. As additional force is applied to the side panel portions 306A, 306B, the lips 906, 914 elastically deform and slide along the curvature of the second face 908B and the third face 916A, until the first lip 906 is released from the channel 918, thereby releasing the interface 700 and enabling the collapsible storage container 100 to continue to transition to the collapsed position 200. Accordingly, the interface 700 acts as a press fit connection between the side panel portions 306A, 306B.

To return the side panel portions 306A, 306B to the collinear position and to reform the interface 700, force is applied to the side panel portions 306A, 306B such the side panel portions 306A, 306B rotate towards a collinear position until the first face 908A abuts the fourth face 916B. As additional force is applied to the side panel portions 306A, 306B, the lips 906, 914 elastically deform and slide along the curvature of the fourth face 916B and the first face 908A, until the first lip 906 slides past the second lip 914 into the channel 918, thereby reforming the interface 700 and moving the collapsible storage container 100 into the deployed position 102.

The illustrated example of FIG. 9 depicts an example implementation of the interface 700. Additionally or alternatively, the interface 700 can include other mechanisms to lock the side panel portions 306A, 306B in a collinear position and the first side panel 108 in a linear position. For example, the interface 700 can include one or more fasteners (e.g., a pin extending through a hole formed in the protruding portions 904, 912, etc.), a collar disposed over the protruding portions 904, 912, etc. Additionally or alternatively, the side panel portions 306A, 306B and/or the first side panel 108 can be held in place manually by a user of the collapsible storage container 100 and/or via an external means (e.g., a chemical adhesive, an item positioned within the collapsible storage container 100 that blocks the rotation of the side panel portions 306A, 306B, a brace extending between the side panels 108, 110, a brace extending between the front panel 104 and the rear panel 106, etc.). In some such examples, the interface 700 can be absent.

Figure 10:
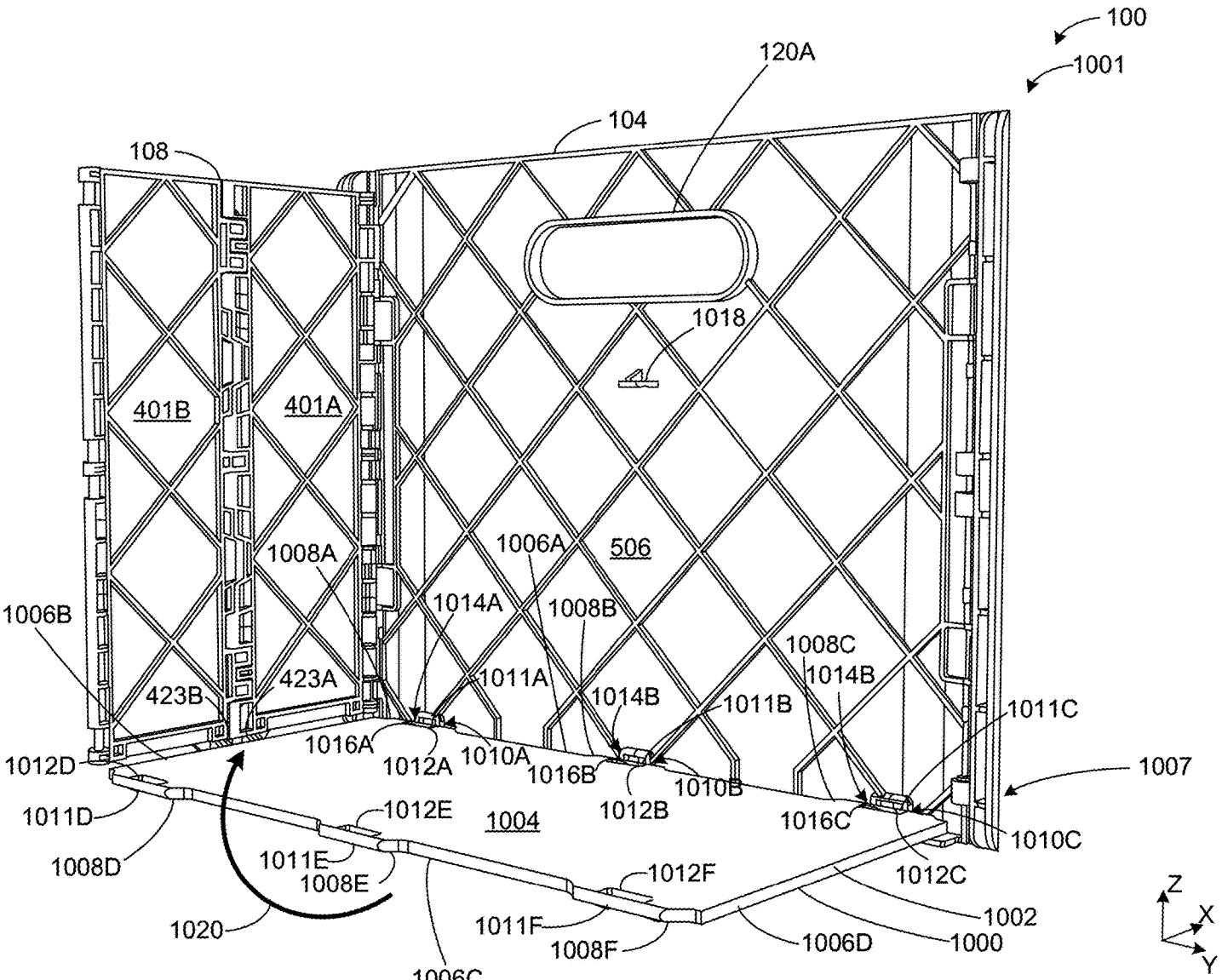
FIG. 10 is a perspective view of the bottom panel of the collapsible storage container of FIG. 1 in a first position.

FIG. 10 is a perspective view of an example bottom panel 1000 of the collapsible storage container of FIG. 1 in an example first position 1001. In the illustrated example of FIG. 10, the bottom panel 1000 includes an example body 1002, an example interior face 1004, an example first edge 1006A, an example second edge 1006B, an example third edge 1006C, and an example fourth edge 1006D. In the illustrated example of FIG. 10, the bottom panel 1000 includes an example first extension 1008A, an example second extension 1008B, an example third extension 1008C, an example fourth extension 1008D, an example fifth extension 1008E, and an example sixth extension 1008F extending from the body 1002. In the illustrated example of FIG. 10, the bottom panel 1000 forms an example joint 1007 with the front panel 104. The joint 1007 includes an example first interface 1010A, an example second interface 1010B, and an example third interface 1010C.

The first position 1001 of the bottom panel 1000 corresponds to a position of the bottom panel 1000 when the collapsible storage container 100 is in the deployed position 102 of FIG. 1. In the first position 1001, the body 1002 of the bottom panel 1000 is disposed in a plane perpendicular to the other panels of the collapsible storage container 100 (e.g., the front panel 104, the rear panel 106, the side panels 108, 110, etc.). The bottom panel 1000 can be moved via an example rotation 1020 about the joint 1007 to other positions. An example position of the bottom panel 1000 corresponding to the collapsed position 200 of FIG. 2 is described below in conjunction with FIG. 11A.

The body 1002 of the bottom panel 1000 is the lower member of the collapsible storage container 100 on which items rest when placed within the collapsible storage container 100. In the illustrated example of FIG. 10, the body 1002 is a generally rectangular member. In other examples, the body 1002 can have any other suitable shape (e.g., another polygonal, a shape depending on the shape of the other panels 104, 106, 108, 110, etc.)

The first edge 1006A is adjacent to the front panel 104 and the second edge 1006B of the rear panel 106. In the illustrated example of FIG. 10, the first edge 1006A is displaced from the interior face 506 to enable the rotation of the bottom panel 1000. In the illustrated example of FIG. 10, the second edge 1006B of the bottom panel 1000 is adjacent the first side panel 108. In the illustrated example of FIG. 10, the second edge 1006B abuts the tabs 423A, 423B. In some examples, the abutment of the second edge 1006B and the tabs 423A, 423B can prevent the side panel portions 306A, 306B from rotating within the cavity 302 of FIG. 3 when the bottom panel 1000 is in the first position 1001. In some examples, the tabs 423A, 423B supports a lower face of the body 1002 when the bottom panel is in the first position 1001. It should be appreciated that the fourth edge 1006D of the bottom panel 1000 can similarly abut tabs of the second side panel 110 (e.g., tabs similar to the tabs 423A, 423B of the first side panel 108, etc.), which can similarly prevent rotation of the side panel portions 306C, 306D of the second side panel 110.

The extensions 1008A, 1008B, 1008C, 1008D, 1008E, 1008F extend from the body 1002. For example, the first extension 1008A, the second extension 1008B, and the third extensions 1008C extend from the first edge 1006A of the body 1002 and the fourth extension 1008D, the fifth extension 1008E, and the sixth extension 1008F extend from the third edge 1006C of the body 1002. In the illustrated example of FIG. 10, the first extension 1008A and the fourth extruded portion are aligned along the horizontal axis, the second extension 1008B and the fifth extension 1008E are centered on the body 1002 and aligned along the horizontal axis, and the third extension 1008C and the sixth extension 1008F are aligned along the horizontal axis. In the illustrated example, the first extension 1008A and the second extension 1008B are adjacent to the second edge 1006B (e.g., a first side of an axis defined the second extension 1008B and the fifth extension 1008E and parallel to the horizontal axis, etc.) and the third extension 1008C and the sixth extension 1008F are adjacent to the fourth edge 1006D (e.g., a second side of an axis defined the second extension 1008B and the fifth extension 1008E and parallel to the horizontal axis, etc.). In other examples, the extensions 1008A, 1008B, 1008C, 1008D, 1008E, 1008F can have any other suitable spatial relationship. In the illustrated example, the transitions between the extensions 1008A, 1008B, 1008C, 1008D, 1008E, 1008F and the corresponding ones of the edges 1006A, 1006C are filleted. In other examples, the transitions can be chamfered, beveled, and/or absent (e.g., the extensions 1008A, 1008B, 1008C, 1008D, 1008E, 1008F form right angles with the edges 1006A, 1006C, etc.).

In the illustrated example of FIG. 10, the extensions 1008A, 1008B, 1008C, 1008D, 1008E, 1008F include an example first cylindrical portion 1011A, an example second cylindrical portion 1011B, an example third cylindrical portion 1011C, an example fourth cylindrical portion 1011D, an example fifth cylindrical portion 1011E, and an example sixth cylindrical portion 1011F, respectively. In the illustrated example of FIG. 10, the extensions 1008A, 1008B, 1008C, 1008D, 1008E, 1008F include an example first cavity 1012A, an example second cavity 1012B, an example third cavity 1012C, an example fourth cavity 1012D, an example fifth cavity 1012E, and an example sixth cavity 1012F, respectively. In the illustrated example of FIG. 10, the front panel 104 includes an example first groove 1014A, an example second groove 1014B, an example third groove 1014C, an example first lip 1016A, an example second lip 1016B, and an example third lip 1016C.

In the illustrated example of FIG. 10, the first cylindrical portion 1011A, the second cylindrical portion 1011B, the third cylindrical portion 1011C, the first groove 1014A, the second groove 1014B, and the third groove 1014C are aligned along the lateral axis. In the illustrated example of FIG. 10, the fourth cylindrical portion 1011D, the fifth cylindrical portion 1011E, and the sixth cylindrical portion 1011F are aligned along the lateral axis. In the illustrated example of FIG. 10, the grooves 1014A, 1014B, 1014C of the front panel 104 receive the cylindrical portions 1011A, 1011B, 1011C, respectively, to form the interfaces 1010A, 1010B, 1010C, respectively. In the illustrated example of FIG. 10, the grooves 1014A, 1014B, 1014C are shaped to receive the cylindrical portions 1011A, 1011B, 1011C, respectively, and to permit the rotation of the cylindrical portions 1011A, 1011B, 1011C, therein. For example, the inner diameter of the grooves 1014A, 1014B, 1014C can have a complimentary curvature to the cylindrical portions 1011A, 1011B, 1011C. In the illustrated example of FIG. 10, the lips 1016A, 1016B, 1016C extend through the cavities 1012A, 1012B, 1012C, respectively. The configuration of the grooves 1014A, 1014B, 1014C and the lips 1016A, 1016B, 1016C are described in greater detail below in conjunction with FIG. 11A.

In some examples, the cylindrical portions 1011A, 1011B, 1011C, are slightly larger in diameter than the opening of the grooves 1014A, 1014B, 1014C (e.g., the gap between the lips 1016A, 1016B, 1016C and the interior face 506, etc.). When is force is applied to the bottom panel 1000 and/or the front panel 104 to form the interfaces 1010A, 1010B, 1010C, the cylindrical portions 1011A, 1011B, 1011C elastically deform and/or the lips 1016A, 1016B, 1016C deflect until the cylindrical portions 1011A, 1011B, 1011C are deposited within the corresponding ones of the grooves 1014A, 1014B, 1014C, thereby forming the interfaces 1010A, 1010B, 1010C. As such, the interfaces 1010A, 1010B, 1010C retain the joint 1007 until a similar force is applied to elastically deform the cylindrical portions 1011A, 1011B, 1011C and/or the lips 1016A, 1016B, 1016C to permit the removal of the cylindrical portions 1011A, 1011B, 1011C therefrom. Accordingly, the interfaces 1010A, 1010B, 1010C act as press-fit connections between the front panel 104 and the bottom panel 1000.

It should be appreciated that the features of the extensions 1008D, 1008E, 1008F (e.g., the cylindrical portions 1011D, 1011E, 1011F, the cavities 1012D, 1012E, 1012F, etc.) can form interfaces (not illustrated) with corresponding features of the rear panel (not illustrated in FIG. 10). In some such examples, the interfaces between the bottom panel 1000 and the rear panel 106 can form a joint (not illustrated) that permits a rotation of the bottom panel towards the rear panel in a manner similar to the rotation 1020 of FIG. 10.

In the illustrated example of FIG. 10, an example tab 1018 extends from the interior face 506 of the front panel 104. The tab 1018 includes features to receive the fifth cylindrical portion 1011E of the bottom panel 1000. In the illustrated example of FIG. 10, the tab 1018 is positioned on the interior face 506 to receive the fifth cylindrical portion 1011E after the rotation 1020. For example, the tab 1018 is disposed on the interior face 506 at a vertical displacement equal to the length between the second extension 1008B and the fifth extension 1008E along the horizontal axis. In the illustrated example of FIG. 10, the tab 1018 is centered on the interior face 506 and the front panel 104 on the lateral axis. While the front panel 104 is depicted as including a single tab (e.g., the tab 1018, etc.) in FIG. 10, in other examples, the front panel 104 can include additional tabs (e.g., a tab positioned to receive the fourth cylindrical portion 1011D, a tab positioned to receive the sixth cylindrical portion 1011F, etc.). An example coupling between the fifth cylindrical portion 1011E and the tab 1018 is described below in conjunction with FIGS. 11A and 11B.

Though a number of edges (e.g., the edges 1006A, 1006B, 1006C, 1006D, etc.), extensions (e.g., 1008A, 1008B, 1008C, 1008D, 1008E, 1008F, etc.), interfaces (e.g., the interfaces 1010A, 1010B, 1010C, etc.), cylindrical portions (e.g., the cylindrical portions 1011A, 1011B, 1011C, 1011D, 1011E, 1011F, etc.), cavities (e.g., 1012A, 1012B, 1012C, 1012C, 1012D, 1012E, 1012F, etc.), grooves (e.g., the grooves 1014A, 1014B, 1014C, etc.), lips (e.g., the lips 1016A, 1016B, 1016C, etc.), and tabs (e.g., the tab 1018, etc.) are illustrated in the example of FIGS. 10 and 11A, in other examples, there may be other numbers (e.g., more or fewer) of edges, extensions, interfaces, cylindrical portions, cavities, grooves, lips, and/or tabs.

FIG. 11A is a perspective view of a bottom panel 1000 the collapsible storage container 100 of FIG. 1 in an example second position 1100. In the illustrated example of FIG. 11A, the front panel 104 includes an example foot 1102, which includes an example first receiving portion 1104A, an example second receiving portion 1104B, an example third receiving portion 1104C, an example protrusion 1106 having an example boss 1108, and an example channel 1110.

The foot 1102 is a planar member disposed in a plane parallel to the horizontal lateral plane. The foot 1102 is disposed at an example bottom edge 1113 of the front panel 104. In the illustrated example of FIG. 11A, the foot 1102 is integral with the front panel 104. In other examples, the foot 1102 can be a discrete component coupled to the bottom edge 1113.

The receiving portions 1104A, 1104B, 1104C are bosses (e.g., extrusions, etc.) of the front panel 104 that are coupled to the extension 1008A, 1008B, 1008C, respectively, to form the interfaces 1010A, 1010B, 1010C, respectively. The first receiving portion 1104A forms the bottom of the first groove 1014A of FIG. 10 and the first lip 1016A extends vertically therefrom. The second receiving portion 1104B forms the bottom of the second groove 1014B of FIG. 10 and the second lip 1016B extends vertically therefrom. The third receiving portion 1104C forms the bottom of the third groove 1014C of FIG. 10 and the third lip 1016C extends vertically therefrom. In the illustrated example of FIG. 11A, the receiving portions 1104A, 1104B, 1104C are integral with the foot 1102. In other examples, the receiving portions 1104A, 1104B, 1104C are discrete components that can be coupled to the foot 1102 during the manufacturing of the collapsible storage container 100 via one or more fastener(s), via one or more welds, via one or more chemical adhesives, via one or more press fits, etc.

In the illustrated example of FIG. 11A, the protrusion 1106 is a generally trapezoidal member. In other examples, the protrusion 1106 can have any other suitable shape. The protrusion 1106 extends horizontally from the foot 1102. In the illustrated example of FIG. 11A, the protrusion 1106 has a filleted transition with the foot 1102. In other examples, the protrusion 1106 can be chamfered, beveled, and/or have no transition with the foot 1102. The boss 1108 extends vertically upward from the protrusion 1106. In the illustrated example of FIG. 11A, the boss 1108 is a half-cylinder. In other examples, the boss 1108 can have any other suitable shape (e.g., a hemisphere, a rectangular prism, etc.).

The channel 1110 is a portion of the foot 1102 that is vertically displaced by the other portion of the foot 1102. In some examples, the rear of the channel 1110 (e.g., corresponding to the exterior face 118A of the front panel 104, etc.) is closed by the exterior face 118A of FIG. 1. In other examples, the channel 1110 can be open (e.g., extends through the exterior face 118A of FIG. 1, etc.). In the illustrated example of FIG. 11A, the hole 1112 is formed in the top face of the channel 1110. The hole 1112 is shaped to receive a corresponding boss of the rear panel 106 when the collapsible storage container 100 is in the collapsed position 200 of FIG. 2.

In the illustrated example of FIG. 11A, the channel 1110 has a substantially the same lateral displacement from the protrusion 1106 from an example foot centerline axis 1114. In other examples, the channel 1110 and the protrusion 1106 can have any other suitable spatial relationship. In other examples, one or both of the protrusion 1106 and/or the channel 1110 can be absent. Additionally or alternatively, the foot 1102 can include additional features (e.g., additional channels similar to the channel 1110, additional protrusions similar to the protrusion 1106, etc.) that couple with corresponding features of the rear panel 106. The protrusion 1106 and the channel 1110 can couple to corresponding features of the rear panel 106 to lock the collapsible storage container 100 in the collapsed position 200 of FIG. 2. For example, the protrusion 1106 can be removably coupled to a feature that is similar to the rear panel 106. In some such examples, the boss 1108 of the protrusion 1106 can be disposed in a hole, similar to the hole 1112. In some such examples, the protrusion 1106 can be received within a channel, similar to the channel 1110.

The second position 1100 of the bottom panel 1000 corresponds to a position of the bottom panel 1000 when the collapsible storage container 100 is in the collapsed position 200 of FIG. 2. For example, the second position 1100 can be reached after the rotation 1020 of FIG. 10. In the second position 1100, the body 1002 of the bottom panel 1000 is disposed in a plane parallel to front panel 104 and the rear panel 106. In the example second position 1100, the bottom panel 1000 is coupled to the front panel 104 via the tab 1018.

In the illustrated example of FIG. 11A, the fifth cylindrical portion 1011E of the bottom panel 1000 is coupled to the tab 1018 to form an example interface 1115. In the illustrated example of FIG. 11A, the tab 1018 includes an example groove 1116 and an example lip 1118. In the illustrated example of FIG. 11A, the groove 1116 is shaped complimentary with the fifth cylindrical portion 1011E, such that the fifth cylindrical portion 1011E can be disposed within the groove 1116. To be disposed within the groove 1116, a force can be applied to the fifth cylindrical portion 1011E, which can cause the fifth cylindrical portion 1011E and/or the lip 1118 to elastically deform and allow the fifth cylindrical portion 1011E to slide into the groove 1116. Accordingly, the interface 1115 acts as a press fit. In some examples, the front panel 104 can include additional tabs to receive the fourth cylindrical portion 1011D of the fourth extension 1008D and/or the sixth cylindrical portion 1011F of the sixth extension 1008F. In some examples, the rear panel 106 can include one or more tabs that permit corresponding ones of the first cylindrical portion 1011A of the first extension 1008A, the second cylindrical portion 1011B of the second extension 1008B, and/or the third cylindrical portion 1011C of the third extension 1008C to be coupled thereto.

Though a number of feet (e.g., the foot 1102, etc.), receiving portions (e.g., the receiving portions 1104A, 1104B, 1104C, etc.), extrusions (e.g., the protrusion 1106, etc.), bosses (e.g., the boss 1108, etc.), channels (e.g., the channel 1110, etc.), and openings (e.g., the hole 1112, etc.) are illustrated in the example of FIG. 11A, in other examples, there may be other numbers (e.g., more or fewer) of feet, receiving portions, extrusions, bosses, channels, and/or openings.

Figure 11B:
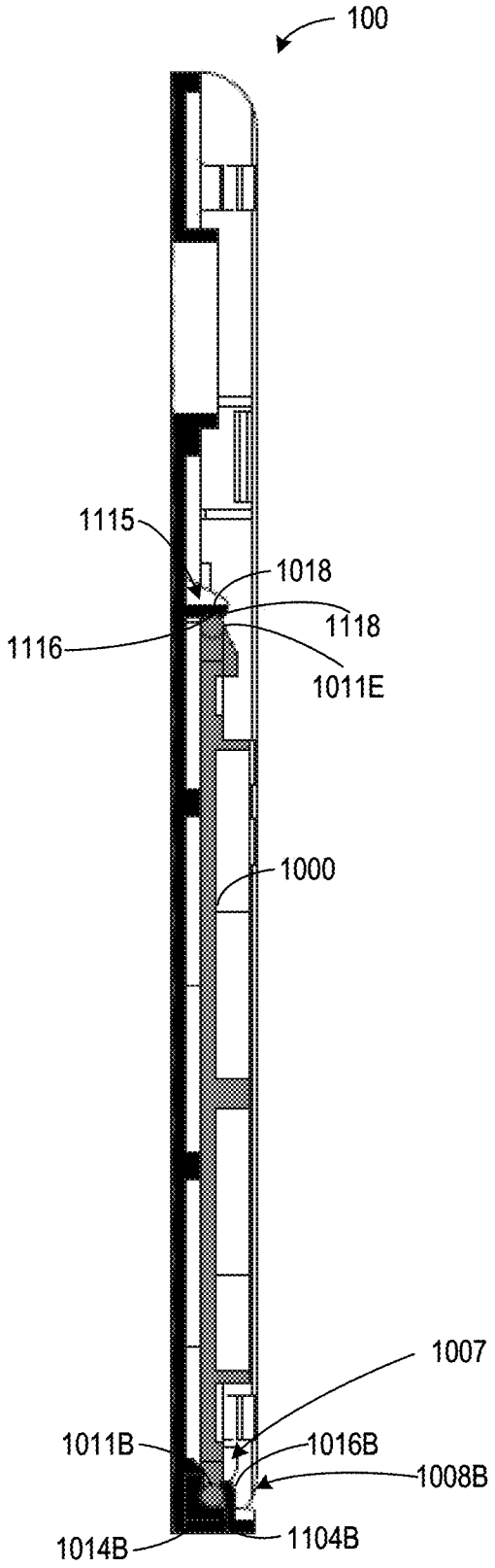
FIG. 11B is a cross-sectional view of a bottom panel of the collapsible storage container of FIG. 1 in the second position of FIG. 11A.

FIG. 11B is a cross-sectional view of the bottom panel 1000 and the front panel 104 in the second position 1100 of FIG. 11A taken along the cross-section line C-C. In the illustrated example of FIG. 11B, the interface 1115 is formed by the deposition of the fifth cylindrical portion 1011E within the groove 1116 of FIG. 11. The interface 1115 inhibits the bottom panel 1000 from rotating towards the first position 1001 of FIG. 10. In some such examples, the lip 1118 prevents the fifth cylindrical portion 1011E from leaving the groove 1116 unless enough force is applied to elastically deform the lip 1118 and/or the fifth cylindrical portion 1011E. In the illustrated example of FIG. 11B, the second interface 1010B of FIGS. 10 and 11B is formed via by deposition of the second cylindrical portion 1011B of FIGS. 10 and 11B within the groove 1014B of FIGS. 10 and 11B, which is defined by the receiving portion 1104B of FIG. 11A and the lip 1016B of FIGS. 10 and 11B. In some examples, the other interfaces of the joint 1007 (e.g., the first interface 1010A and the third interface 1010C, etc.) can be formed similarly to the second interface 1010B as depicted in FIG. 11B. In other examples, the first interface 1010A and the third interface 1010C can be formed in any other suitable manner.

Figure 12A:
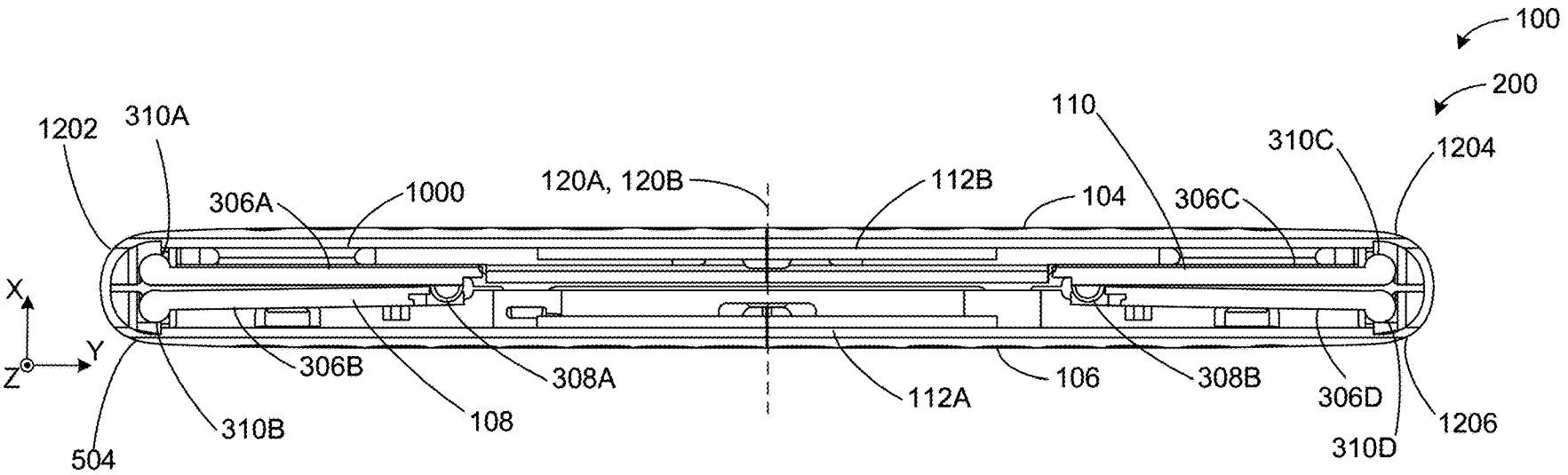
FIG. 12A is a top view of the collapsible storage container of FIG. 1 in the collapsed position of FIG. 2.

FIG. 12A is a top view of the collapsible storage container 100 of FIG. 1 in the collapsed position 200 of FIG. 2. In the illustrated example of FIG. 12A, the front panel 104 includes an example first end portion 1202 adjacent the first side panel 108 and an example second end portion 1204 adjacent to the second side panel 110. In the illustrated example of FIG. 12A, the rear panel 106 includes the example end portion 504 (referred the third end portion 504 in conjunction with FIG. 12A), and an example fourth end portion 1206 adjacent the first side panel 108 and an example fourth end portion 1206 adjacent the second side panel 110.

Respective ones of the end portions 1202, 1204, 504, 1206 are integral with a corresponding one of the panels 104, 106. In the illustrated example of FIG. 12A, the first end portion 1202 of the front panel 104 abuts the third end portion 504 of the rear panel 106. The second end portion 1204 of the front panel 104 abuts the fourth end portion 1206 of the rear panel 106. In the illustrated example of FIG. 12A, the end portions 1202, 1204, 504, 1206 have the same size and shape. In other examples, some or all of the end portions 1202, 1204, 504, 1206 can have any other suitable size(s) and/or shape(s). In the illustrated example of FIG. 12A, the first end portion 1202 radially surrounds the first corner joint 310A of FIG. 3, the second end portion 1204 radially surrounds the third corner joint 310C, the third end portion 504 radially surrounds the second corner joint 310B, and the fourth end portion 1206 radially surrounds the fourth corner joint 310D.

In the illustrated example of FIG. 12A, the side panels 108, 110, and the bottom panel 1000 of FIG. 10 are disposed in the interior (e.g., the cavity 302 of FIG. 2, etc.) of the collapsible storage container 100 in the collapsed position 200. For example, the side panel portions 306A, 306B of the first side panel 108 have been rotated about the first side joint 308A, the first corner joint 310A, and the second corner joint 310B into the interior of the collapsible storage container 100. In the illustrated example of FIG. 12A, the bottom panel 1000 is in the second position 1100 of FIG. 11A and is disposed in a plane substantially parallel to the front panel 104 and the rear panel 106 and abuts the front panel 104. For example, the bottom panel 1000 has been rotated (e.g., via the rotation 1020 of FIG. 10) about the joint 1007 of FIGS. 10 and 11 (not illustrated in FIG. 12A).

In the illustrated example of FIG. 12A, the first side panel portion 306A abuts the bottom panel 1000 and is disposed in a plane parallel to the front panel 104, the rear panel 106, the bottom panel 1000, the second side panel portion 306B, the third side panel portion 306C, and the fourth side panel portion 306D. In the illustrated example of FIG. 12A, the second side panel portion 306B abuts the rear panel 106 is disposed in a plane parallel to the front panel 104, the rear panel 106, the bottom panel 1000, the first side panel portion 306A, the third side panel portion 306C, and the fourth side panel portion 306D. In the illustrated example of FIG. 12A, the third side panel portion 306C abuts the bottom panel 1000 and is disposed in a plane substantially parallel to the front panel 104, the rear panel 106, the bottom panel 1000, the first side panel portion 306A the second side panel portion 306B, and the fourth side panel portion 306D. In the illustrated example of FIG. 12A, the fourth side panel portion 306D abuts the rear panel 106 is disposed in a plane substantially parallel to the front panel 104, the rear panel 106, the bottom panel 1000, the first side panel portion 306A, the second side panel portion 306B, and the third side panel portion 306C. In some such examples, the first side panel portion 306A and the third side panel portion 306C are coplanar. In some such examples, the second side panel portion 306B and the fourth side panel portion 306D are coplanar.

The abutment of the first end portion 1202 and the third end portion 504 and the abutment of the first end portion 1202 and the fourth end portion 1206 conceal the interior features of the collapsible storage container 100. For example, the abutment of the first end portion 1202 and the third end portion 504 block (e.g., protect, conceal, etc.) access to the side panel portions 306A, 306B, the first side joint 308A, and the corner joints 310A, 310B. For example, the abutment of the second end portion 1204 and the fourth end portion 1206 block (e.g., protect, conceal, etc.) access to the side panel portions 306C, 306D, the second side joint 308B, and the corner joints 310C, 310D.

In the illustrated example of FIG. 12A, in the collapsed position 200, the side panel portions 306A, 306B, 306C, 306D have been folded inward such that the side joints 308A, 308B are disposed in the interior of the collapsible storage container 100. In the illustrated example of FIG. 12A, the side joints 308A, 308B do not obstruct access the handles 112A, 112B. In some examples, a user can hold the collapsible storage container 100 in the collapsed position 200 by extending a hand through the handles 112A, 112B such that their fingers rest on one of the handles (e.g., the first handle 112A, etc.) and their palm rest on the other one of the handles (e.g., the second handle 112B, etc.). Accordingly, the collapsible storage container 100 can be carried with one hand in the collapsed position 200. In the illustrated example of FIG. 12A, the front panel 104 and the rear panel 106 are disposed in substantially parallel planes. Accordingly, in the collapsed position 200, the collapsible storage container 100 can be stacked or packaged with other collapsible storage containers implemented in accordance with the teachings of this disclosed with a comparatively minimal amount of empty space.

Figure 12B:
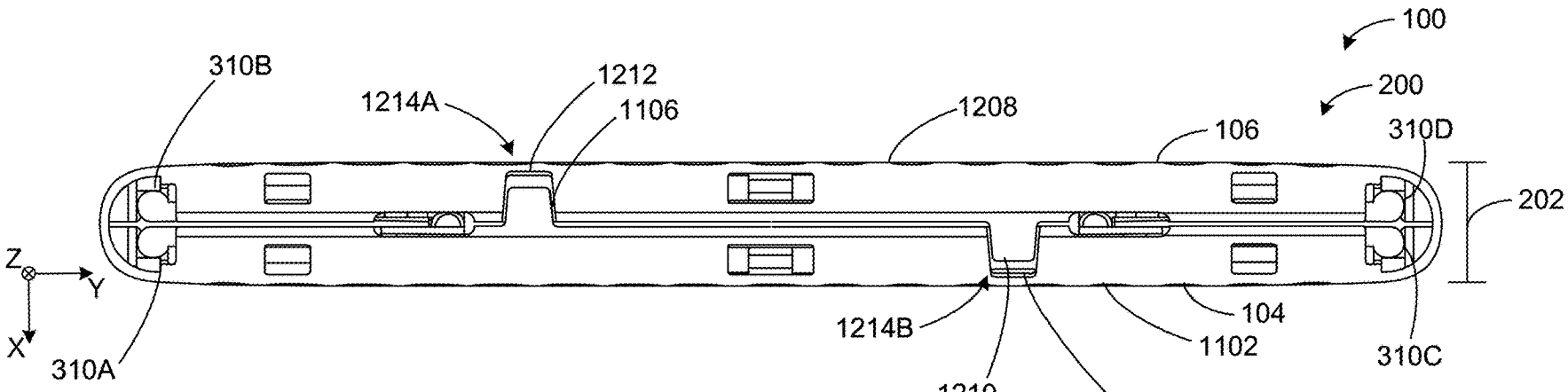
FIG. 12B is a bottom view of the collapsible storage container of FIG. 1 in the collapsed position of FIG. 2.

FIG. 12B is a bottom view of the collapsible storage container 100 of the collapsible storage container of FIG. 1 in the collapsed position 200 of FIG. 2. In the illustrated example of FIG. 12B, the front panel 104 includes the foot 1102 of FIG. 11A (referred to as the first foot 1102 in conjunction with FIG. 12B), the protrusion 1106 of FIG. 11A (referred to as the first protrusion 1106 in conjunction with FIG. 12B), and the channel 1110 of FIG. 11A (referred to as the first channel 1110 in conjunction with FIG. 12B). In the illustrated example of FIG. 12B, the rear panel 106 includes an example second foot 1208, an example second protrusion 1210, and an example second channel 1212. In the illustrated example of FIG. 12B, in the collapsed position 200, the first protrusion 1106 and the second channel 1212 form an example first retention interface 1214A, and the second protrusion 1210 and the first channel 1110 form an example second retention interface 1214B.

The first retention interface 1214A and the second retention interface 1214B are retention locks that lock the collapsible storage container 100. For example, the retention interfaces 1214A, 1214B lock the distance between the front panel 104 and the rear panel 106 as the collapsed position 200 and prevent the distance between the panels 104, 106 from expanding. In some such examples, because the distance between the front panel 104 and the rear panel 106 cannot expand, the side panels 108, 110 are prevented from rotating into a collinear position and the bottom panel 1000 is prevented from rotating the first position 1001 of FIG. 10.

In the collapsed position 200, the first foot 1102 abuts the second foot 1208 such that first retention interface 1214A is formed between the first protrusion 1106 and the second channel 1212 and the second retention interface 1214B is formed between the second protrusion 1210 and the first channel 1110. For example, a boss of the first protrusion 1106 (e.g., the boss 1108 of FIG. 11A, etc.) is to be disposed in a corresponding hole of the second channel 1212 (e.g., a hole similar to the hole 1112 of FIG. 11A, etc.). Similarly, a boss of the second protrusion 1210 (e.g., a boss similar to the boss 1108 of FIG. 11A, etc.) is to be disposed in a corresponding hole of the first channel 1110 (e.g., the hole 1112 of FIG. 11A, etc.). In some such examples, the horizontal contact between the boss of the first protrusion 1106 and the hole of the second channel 1212 and the between the boss of the second protrusion 1210 and the hole of the first channel 1110 locks the position of the front panel 104 and the rear panel 106.

In the illustrated example of FIG. 12B, the collapsible storage container 100 includes two interfaces (e.g., the first retention interface 1214A, the second retention interface 1214B, etc.). In other examples, the collapsible storage container 100 can include any suitable number of interface(s) (e.g., one interface, three interfaces, etc.). Additionally or alternatively, the retention interfaces 1214A, 1214B can include other mechanisms to lock the distance between the front panel 104 and the rear panel 106. For example, the retention interfaces 1214A, 1214B can include one or more fasteners (e.g., a pin extending through a hole formed in the feet 1102, 1208, etc.), one or more buckles, etc.

Figure 13:
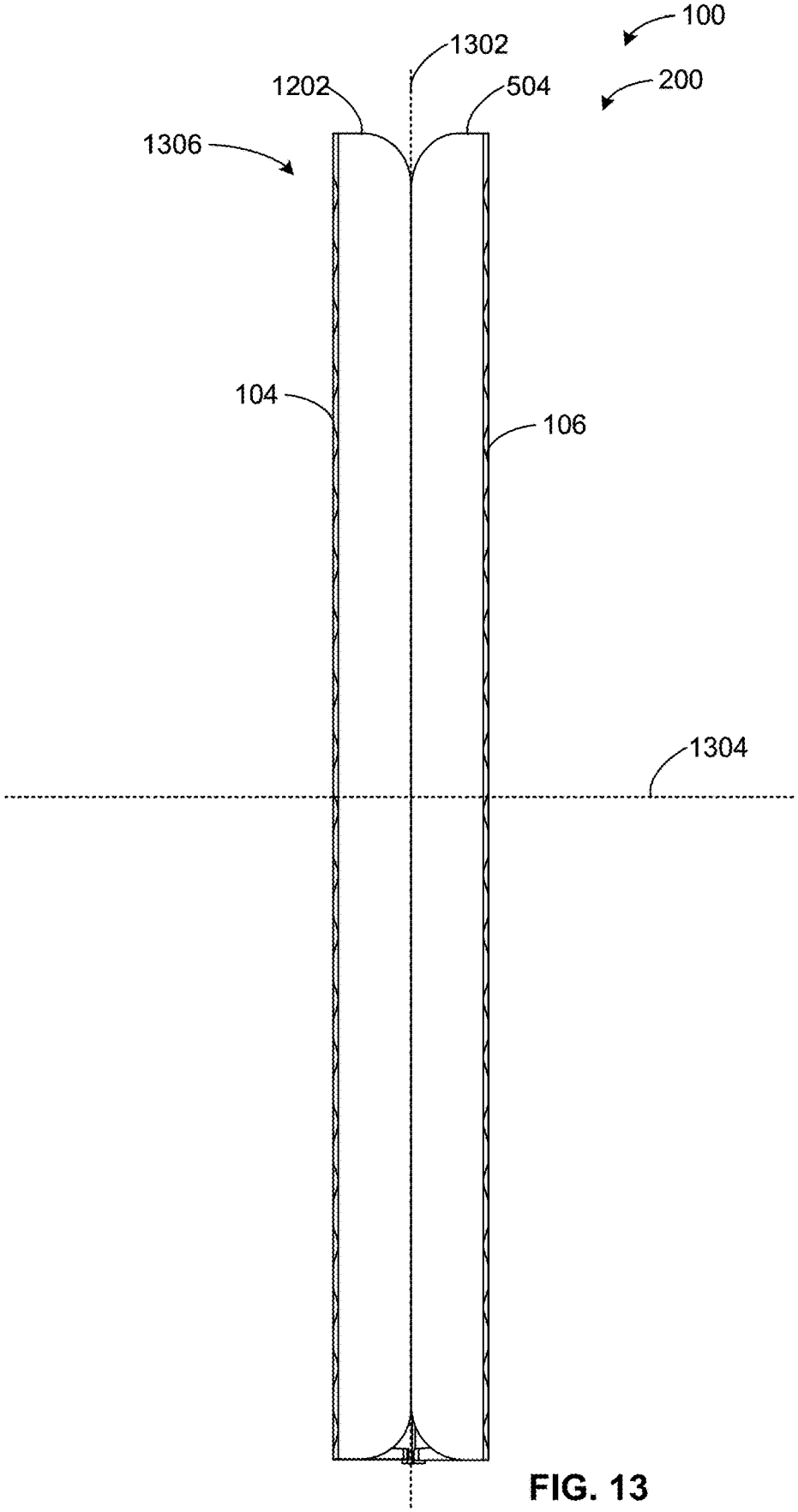
FIG. 13 is a side view of the collapsible storage container of FIG. 1 in the collapsed position of FIG. 2.

FIG. 13 is a side view of the collapsible storage container 100 of FIG. 1 in the collapsed position of FIG. 2. In the illustrated example of FIG. 13, the first end portion 1202 of the front panel 104 abuts the third end portion 504 of the rear panel 106 along an example vertical centerline axis 1302. In the illustrated example of FIG. 13, the first end portion 1202 of the front panel 104 abuts the third end portion 504 along the entire length of the vertical centerline axis 1302. In other examples, the first end portion 1202 of the front panel 104 abuts the third end portion 504 along only a portion of the vertical centerline axis. In the illustrated example of FIG. 13, the collapsible storage container 100 is symmetrical about the vertical centerline axis 1302 and an example horizontal centerline axis 1304.

In the illustrated example of FIG. 12A-13, the first end portion 1202, and the third end portion 504 form a continuous curved side profile 1306. In the illustrated example of FIG. 13, the continuous curved face profile 1306 is a half-ellipse. In other examples, the continuous curved face profile 1306 can be a half-circle, a circle segment, an ellipse segment, a parabola, etc.

Figure 14:
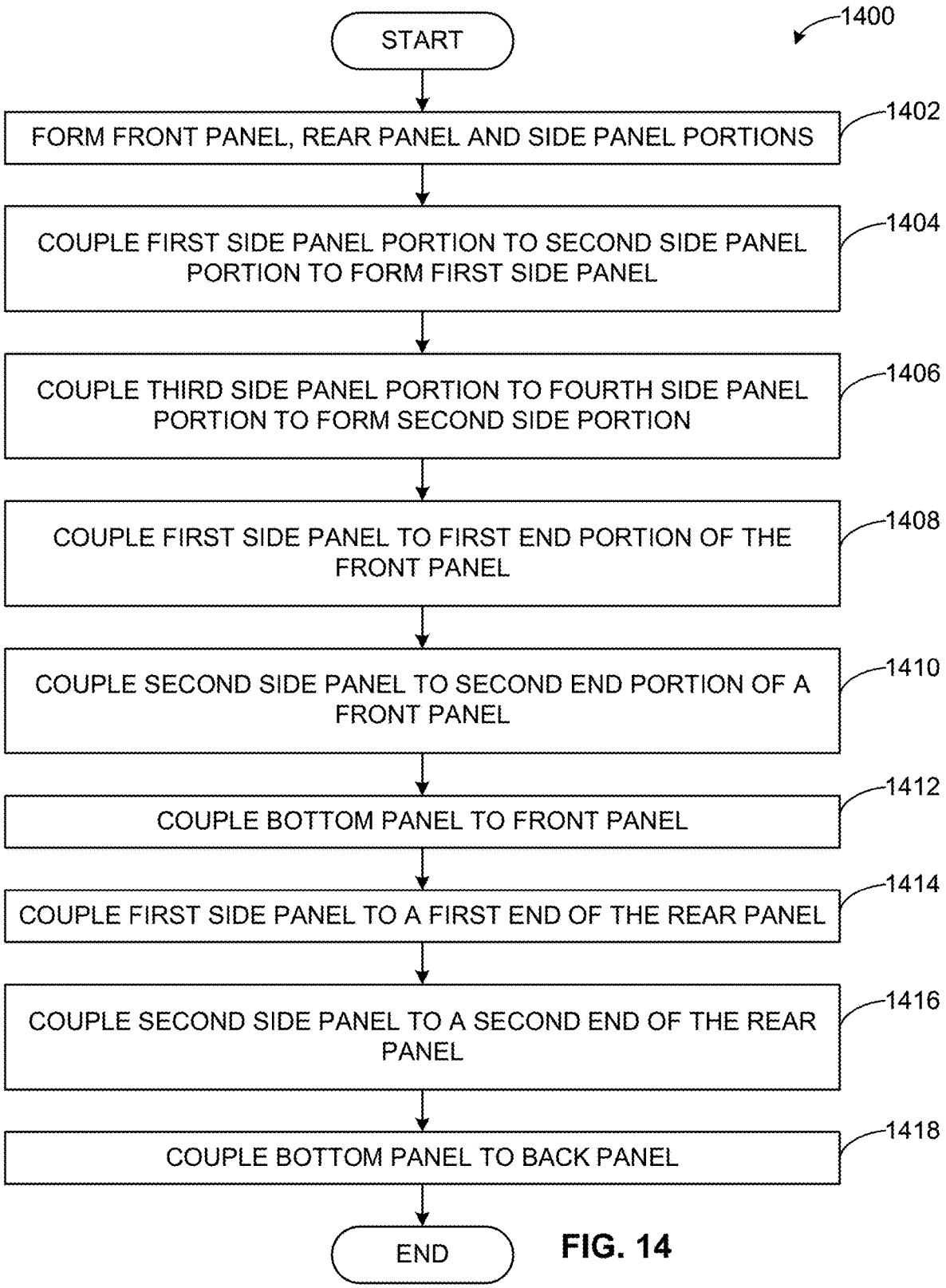
FIG. 14 is a flow diagram of example operations that can be used to manufacture and assemble the collapsible storage container of FIGS. 1-13.

FIG. 14 is a flow diagram of example operations 1400 that can be used to manufacture and assemble the collapsible storage container of FIGS. 1-13. The operations 1400 begin at block 1402. At block 1402, the front panel 104, the rear panel 106, and the side panel portions 306A, 306B, 306C, 306D are formed. For example, the front panel 104, the rear panel 106, and the side panel portions 306A, 306B, 306C, 306D can be manufactured via injection molding. In other examples, some or all of the front panel 104, the rear panel 106, and the side panel portions 306A, 306B, 306C, 306D can be manufactured via additive manufacturing (e.g., material jetting, binder jetting, powder bed fusion, etc.), casting, machining, stamping, and/or any other suitable manufacturing technique.

At block 1404, the first side panel portion 306A is coupled to the second side panel portion 306B to form the first side panel 108. For example, the first side panel portion 306A can be joined to the second side panel portion 306B via the first side joint 308A. In some such examples, the pin portions 802A, 802B, 802C, 802D of FIGS. 8A and 8B of first side panel portion 306A can be joined with the outer walls 803A, 803B, 803C, 803D, respectively via one or more press fits. In some examples, the first side joint 308A rotatably couples the first side panel portion 306A and the second side panel portion 306B. At block 1406, the third side panel portion 306C is coupled to the fourth side panel portion 306D to form the second side panel 110. For example, the third side panel portion 306C can be joined to the fourth side panel portion 306D via the second side joint 308B. In some such examples, the second side joint 308B can be formed similarly to the first side joint 308A (e.g., by joining pin portions of the third side panel portion 306C to corresponding receiving portions of the fourth side panel portion 306D via press fits, etc.). In other examples, the third side panel portion 306C can be joined to the fourth side panel portion 306D by any other suitable joint.

At block 1408, the first side panel 108 is coupled to the first end portion 1202 of the front panel 104. For example, the first side panel 108 can be joined to the front panel 104 via the first side joint 308A. For example, the pin portions 404A, 404B, 404C, 404D of the first side panel 108 can be joined with corresponding receiving portions of the front panel 104 to form the first side joint 308A. In other examples, the first side panel 108 can be joined to the front panel 104 by any other suitable joint. At block 1410, the second side panel 110 is coupled to the second end portion 1204 of the front panel 104. For example, the first side panel 108 can be joined to the front panel 104 via the third corner joint 310C. For example, the pin portions of the first side panel 108 (e.g., pin portions similar to the pin portions 404A, 404B, 404C, 404D, 404E, 404F of FIGS. 4A and 4B, etc.) can be joined with corresponding receiving portions (e.g., receiving portion similar to the receiving portions 510A, 510B, 510C, 510D of FIG. 5, etc.) of the front panel 104 to form the third corner joint 310C. In other examples, the second side panel 110 can be joined to the second end portion 1204 by any other suitable joint.

At block 1412, the bottom panel 1000 is coupled to the front panel 104. For example, the bottom panel 1000 can be coupled to the front panel 104 via the joint 1007. For example, the cylindrical portions 1011A, 1011B, 1011C can be coupled to corresponding ones of the grooves 1014A, 1014B, 1014C of the front panel 104 to form the interfaces 1010A, 1010B, 1010C, respectively. In other examples, the bottom panel 1000 can be formed in any other suitable manner.

At block 1414, the first side panel 108 is coupled to the third end portion 504 of the rear panel 106. For example, the first side panel 108 can be joined to the front panel 104 via the third corner joint 310C. For example, the pin portions 404E, 404F, 404G, 404H of the first side panel 108 can be joined with the receiving portions 510A, 510B, 510C, 510D of FIG. 4 of the front panel 104 to form the third corner joint 310C. In other examples, the first side panel 108 can be joined to the rear panel 106 by any other suitable joint.

At block 1416, the second side panel 110 is coupled to the fourth end portion 1206 of the rear panel 106. For example, the second side panel 110 can be joined to the rear panel 106 via the fourth corner joint 310D. For example, the pin portions of the second side panel 110 (e.g., pin portions similar to the pin portions 404A, 404B, 404C, 404D, 404E, 404F of FIGS. 4A and 4B, etc.) can be joined with corresponding receiving portions (e.g., receiving portion similar to the receiving portions 510A, 510B, 510C, 510D of FIG. 5, etc.) of the rear panel 106 to form the fourth corner joint 310D. In other examples, the second side panel 110 can be joined to the fourth end portion 1206 by any other suitable joint. At block 1418, the bottom panel 1000 is coupled to the rear panel 106. For example, the bottom panel 1000 can be coupled to the front panel 104 via a hinged joint, similar to the joint 1007. For example, the cylindrical portions 1011D, 1011E, 1011F can be coupled to corresponding to the channels (e.g., similar to the grooves 1014A, 1014B, 1014C of FIG. 10, etc.) of the rear panel 106 to form the interfaces (e.g., interfaces similar to the interfaces 1010A, 1010B, 1010C of FIG. 10). In other examples, the bottom panel 1000 can be formed in any other suitable manner.

Although the example operations 1400 are described with reference to the flowchart illustrated in FIG. 14, many other methods of manufacturing and assembling the collapsible storage container 100 disclosed herein may alternatively be used. For example, the order of execution of the blocks may be changed, and/or some of the blocks described may be changed, eliminated, or combined.

Figure 15:
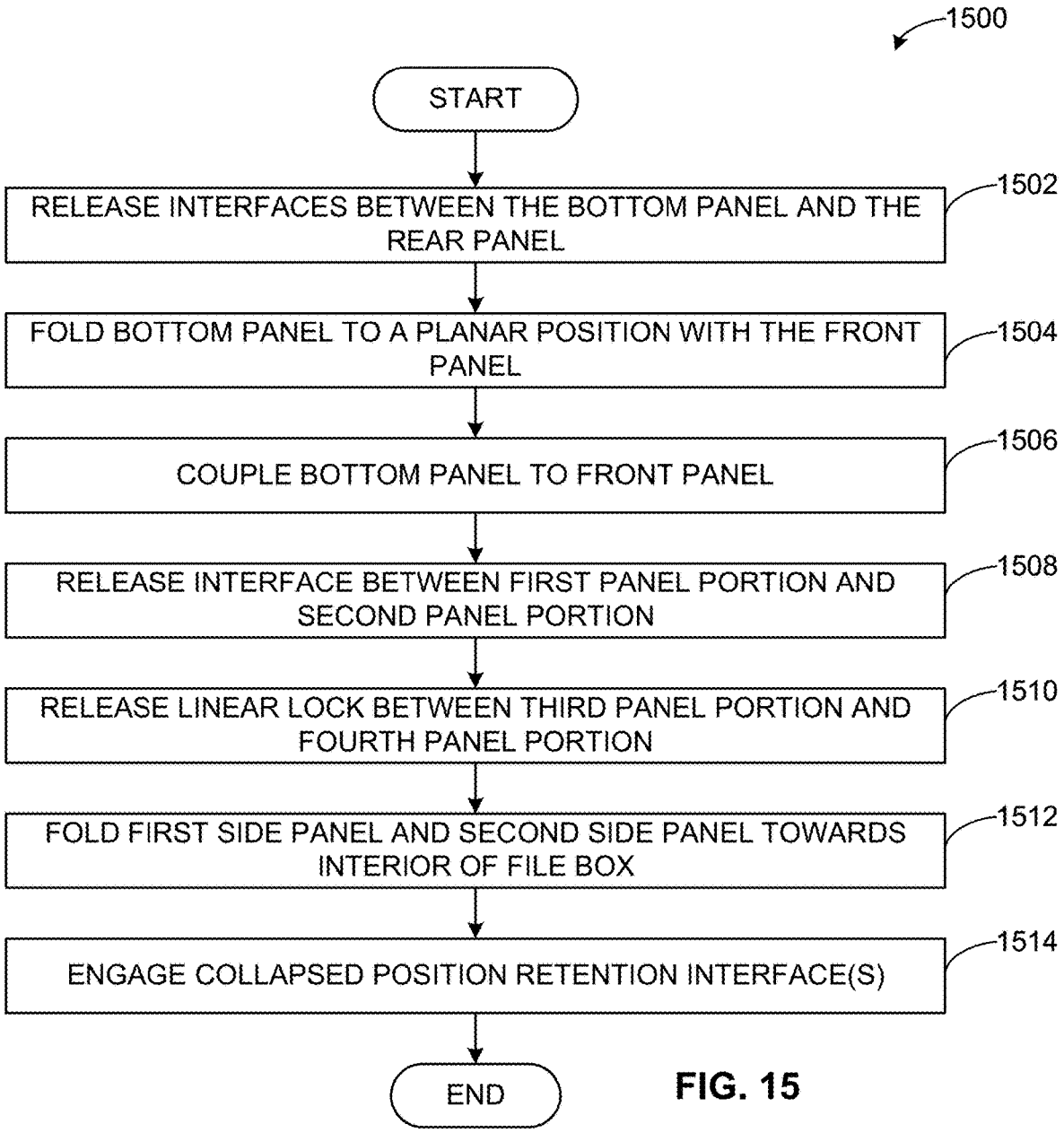
FIG. 15 is a flow diagram of example operations that can be used to move the collapsible storage container of FIGS. 1-13 from the deployed position of FIG. 1 to the collapsed position of FIG. 2.

FIG. 15 is a flow diagram of example operations that can be used to move the collapsible storage container of FIGS. 1-13 from the deployed position of FIG. 1 to a collapsed position of FIG. 2. At block 1502, the interfaces between the bottom panel 1000 and the rear panel are released. For example, the interfaces between the cylindrical portions 1011D, 1011E, 1011F of the bottom panel 1000 can be released from the corresponding receiving portions of the rear panel 106. At block 1504, the bottom panel 1000 is rotated to a planar position with the front panel 104. For example, the bottom panel 1000 can be rotated via the rotation 1020 about the joint 1007.

At block 1506, the bottom panel 1000 is coupled to the front panel 104. For example, the bottom panel 1000 can be coupled to the front panel 104 via the tab 1018 by depositing the front panel 104 in the groove 1116 of the tab 1018 via a press fit. In other examples, the bottom panel 1000 can be coupled to the front panel 104 in any other suitable manner. At block 1508, the interface 700 between the first side panel portion 306A and the second side panel portion 306B can be released by applying force to the first side joint 308A between first side panel portion 306A and/or the second side panel portion 306B such that the first lip 906 is released from the channel 918 by sliding past the second lip 914. At block 1510, the interface between the third side panel portion 906C and the fourth side panel portion 306D can be released in a manner similar to the release of the interface 700 (e.g., by applying a force to the second side joint 308B, etc.). In other examples, the interface between the third side panel portion 906C and the fourth side panel portion 306D in any other suitable manner.

At block 1512, the first side panel 108 and the second side panel 110 are folded towards the cavity 302 of the collapsible storage container 100. For example, the first side panel 108 and the second side panel 110 can be rotated about the side joints 308A, 308B until the side panel portions 306A, 306B, 306C, 306D are disposed in a plane parallel to the front panel 104 and the rear panel 106. At block 1514, the collapsed retention interfaces 1214A, 1214B are engaged. For example, the first protrusion 1106 and the second channel 1212 can be engaged to form the first retention interface 1214A and the second protrusion 1210 and the first channel 1110 can be engaged to form the second retention interface 1214B. The operations 1500 end.

Although the example operations 1500 are described with reference to the flowchart illustrated in FIG. 15, many other methods of collapsing the collapsible storage container 100 disclosed herein may alternatively be used. For example, the order of execution of the blocks may be changed, and/or some of the blocks described may be changed, eliminated, or combined.

Figure 16:
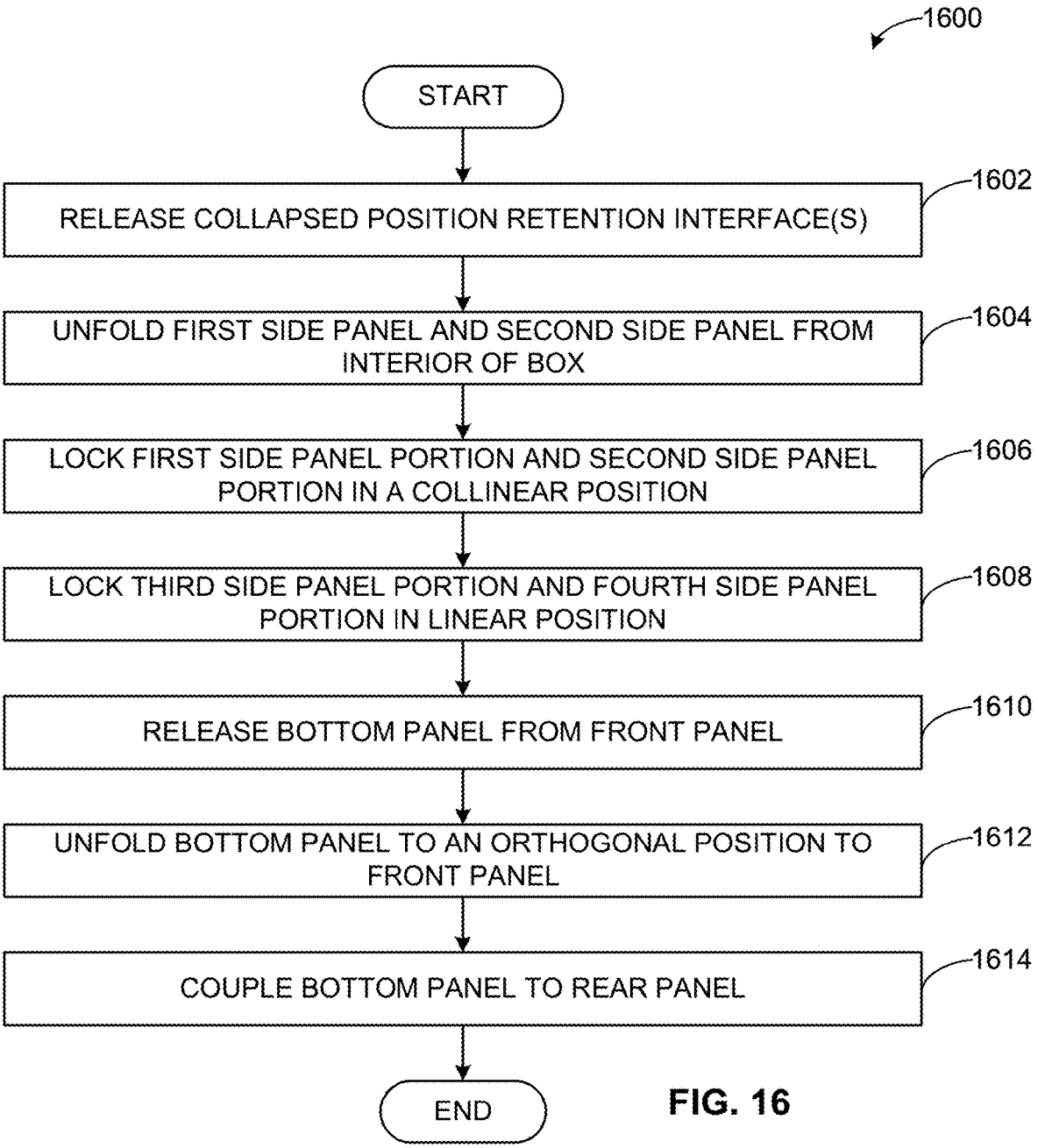
FIG. 16 is a flow diagram of example operations that can be used to move the collapsible storage container of FIGS. 1-13 from the collapsed position of FIG. 2 to the deployed position of FIG. 1.

FIG. 16 is a flow diagram of example operations that can be used to move the collapsible storage container of FIGS. 1-13 from the collapsed position of FIG. 2 to the deployed position of FIG. 1. The operations 1600 begin at block 1602, at which the collapsed retention interfaces 1214A, 1214B are released (e.g., disengaged, etc.). For example, the first protrusion 1106 can be disengaged from the second channel 1212 by pulling the protrusion 1106 away from the collapsible storage container 100 to remove the boss 1108 from a hole of the second channel 1212 to release the retention interfaces 1214A. Similarly, the second protrusion 1210 can be disengaged from the first channel 1110 by pulling the second protrusion 1210 away from the collapsible storage container 100 to remove a boss of the second protrusion 1210 from a hole of the second channel 1212 to release the retention interfaces 1214B. In other examples, the retention interfaces 1214A, 1214B can be disengaged in any other suitable manner.

At block 1604, the first side panel 108 and the second side panel 110 are unfolded from the cavity 302 of the collapsible storage container 100. For example, the first side panel 108 and the second side panel 110 can be rotated about the side joints 308A, 308B until the side panel portions 306A, 306B, 306C, 306D are disposed in planes perpendicular to the front panel 104 and the rear panel 106. At block 1606, the first side panel portion 306A and the second side panel portion 306B are locked in a collinear position. For example, the interface 700 between the side panel portions 306A, 306B can be engaged by disposing the lip 906 of the first side panel portion 306A within the channel 918 of the second side panel portion 306B via a press fit. At block 1608, the third side panel portion 306C and the fourth side panel portion 306D are locked in a collinear position. For example, an interface similar to the interface 700 can be engaged via a press fit. In other examples, the third side panel portion 306C and the fourth side panel portion 306D can be locked in a collinear position in any other suitable manner.

At block 1610, the bottom panel 1000 is released from the front panel 104. For example, the bottom panel 1000 can be released from a press fit within the groove 1116 of the tab 1018 disposed on the front panel 104 by applying a force to the bottom panel 1000. At block 1612, the bottom panel 1000 is unfolded to an orthogonal position to the front panel 104. For example, the bottom panel 1000 can be rotated from the second position 1100 of FIG. 11A to the first position 1001 of FIG. 10. At block 1614, the bottom panel 1000 is coupled to the rear panel 106. For example, the cylindrical portions 1011D, 1011E, 1011F of the bottom panel 1000 can be disposed within corresponding features on the foot 1208 of the rear panel (e.g., features similar to the receiving portions 1104A, 1104B, 1104C of FIG. 11A, etc.). After the bottom panel 1000 has been coupled to the rear panel 106, the collapsible storage container 100 is in the collapsed position 200 of FIG. 2. The operations 1600 then end.

Although the example operations 1600 are described with reference to the flowchart illustrated in FIG. 16, many other methods of deploying the collapsible storage container 100 disclosed herein may alternatively be used. For example, the order of execution of the blocks may be changed, and/or some of the blocks described may be changed, eliminated, or combined.

Example methods, apparatus, systems, and articles of manufacture for collapsible storage containers are disclosed herein. Further examples and combinations thereof include the following:

Example 1 includes a storage container movable between a deployed position and a collapsed position, the apparatus comprising a front panel, a back panel, and a side panel including a first side panel portion coupled to the front panel, the first side panel portion including a first face, and a second side panel portion coupled to the back panel, the second side panel portion including a second face, the first face coplanar with the second face in the deployed position, the first face parallel to and abutting the second face in the collapsed position.

Example 2 includes the storage container of any preceding example, wherein the front panel includes an interior face, the interior face abutting the second side panel portion in the collapsed position, the interior face including a ridge pattern.

Example 3 includes the storage container of any preceding example, wherein the front panel includes a first handle, the back panel includes a second handle, and the first handle and the second handle are aligned in the collapse position.

Example 4 includes the storage container of any preceding example, wherein the first handle is a pill-shaped opening in the front panel.

Example 5 includes the storage container of any preceding example, further including a bottom panel orthogonal to the side panel and the front panel in the deployed position, the bottom panel parallel to the front panel in the collapsed position.

Example 6 includes the storage container of any preceding example, wherein the first side panel portion includes a third face opposite the first face, the third face parallel to and abutting the bottom panel in the collapsed position.

Example 7 includes the storage container of any preceding example, wherein a first end of the bottom panel is removably coupled to the back panel via a first joint in the deployed position and a second end is coupled to the front panel via a second joint, the bottom panel rotating about the second joint between the collapsed position and the deployed position.

Example 8 includes the storage container of any preceding example, wherein the front panel includes an interior face, the interior face including a tab removably coupled to a cylindrical portion of the bottom panel in the collapsed position.

Example 9 includes the storage container of any preceding example, wherein the bottom panel includes a body and a extension extending from the body, the extension including the cylindrical portion and an opening defined by the cylindrical portion, the first joint including a channel disposed on the front panel, the channel including a lip, the cylindrical portion disposed in the channel, the opening receiving the lip.

Example 10 includes the storage container of any preceding example, wherein the first joint includes the cylindrical portion of the bottom panel.

Example 11 includes the storage container of any preceding example, wherein the cylindrical portion is a first cylindrical portion disposed on an edge of the bottom panel and the first joint further includes a second cylindrical portion disposed on a first side of the edge of the bottom panel, and a third cylindrical portion disposed on a second side of the edge of the bottom panel, the second side different than the first side.

Example 12 includes the storage container of any preceding example, wherein the second side panel portion includes a third face opposite the second face, the third face parallel to and abutting the back panel in the collapsed position.

Example 13 includes the storage container of any preceding example, wherein the first side panel portion is coupled to the front panel via a first piano joint, and the second side panel portion is coupled to the back panel via a second piano joint.

Example 14 includes the storage container of any preceding example, wherein the first side panel portion includes a receiving portion, and the second side panel portion includes a pin portion, the pin portion, and the receiving portion forming a joint between the first side panel portion and the second side panel portion.

Example 15 includes the storage container of any preceding example, wherein the receiving portion extends from the first face.

Example 16 includes the storage container of any preceding example, wherein the first side panel portion includes a first edge, and the second side panel portion includes a second edge abutting the first edge in the deployed position, the first edge and the second edge forming a press-fit connection in the deployed position.

Example 17 includes the storage container of any preceding example, wherein the front panel includes a first end and the back panel includes a second end, the first end, and the second end forming a continuous curved face in the collapsed position.

Example 18 includes the storage container of any preceding example, wherein the front panel includes a first bottom end including a tab, and the back panel includes a second bottom end including an opening, the tab and the opening forming a coupling in the collapsed position.

Example 19 includes the storage container of any preceding example, wherein the tab is a first tab, the opening is a first opening, the coupling is a first coupling, the first bottom end includes a second opening, the second bottom end includes a second tab, and the second tab and the second opening forming a second coupling in the collapsed position.

Example 20 includes the storage container of any preceding example, wherein the apparatus has a first length in the deployed position, the apparatus has a second length in the collapsed position, and a ratio of the first length to the second length is between 4 and 20.

The following claims are hereby incorporated into this Detailed Description by this reference. Although certain example systems, methods, apparatus, and articles of manufacture have been disclosed herein, the scope of coverage of this patent is not limited thereto. On the contrary, this patent covers all systems, methods, apparatus, and articles of manufacture fairly falling within the scope of the claims of this patent.

What is claimed is:

1. A storage container movable between a deployed position and a collapsed position, the storage container comprising:

a front panel including an interior face, the interior face including a tab;

a back panel;

a side panel including:

a first side panel portion coupled to the front panel, the first side panel portion including a first face; and a second side panel portion coupled to the back panel, the second side panel portion including a second face, the first face coplanar with the second face in the deployed position, the first face parallel to and abutting the second face in the collapsed position; and a bottom panel orthogonal to the side panel and the front panel in the deployed position, the bottom panel parallel to the front panel in the collapsed position, the bottom panel including a cylindrical portion, the tab removably coupled to the cylindrical portion of the bottom panel in the collapsed position.

2. The storage container of claim 1, wherein the interior face abuts the second side panel portion in the collapsed position and the interior face including a ridge pattern.

3. The storage container of claim 1, wherein the front panel includes a first handle, the back panel includes a second handle, and the first handle and the second handle are aligned in the collapsed position.

4. The storage container of claim 1, wherein the first handle is a pill-shaped opening in the front panel.

5. The storage container of claim 1, wherein the first side panel portion includes a third face opposite the first face, the third face parallel to and abutting the bottom panel in the collapsed position.

6. The storage container of claim 1, wherein a first end of the bottom panel is removably coupled to the back panel via a first bottom joint in the deployed position and a second end is coupled to the front panel via a second bottom joint, the bottom panel rotating about the second joint between the collapsed position and the deployed position.

7. The storage container of claim 6, wherein the bottom panel includes a body and an extension extending from the body, the extension including the cylindrical portion and an opening defined by the cylindrical portion, the first bottom joint including a channel disposed on the front panel, the channel including a lip, the cylindrical portion disposed in the channel, the opening receiving the lip.

8. The storage container of claim 6, wherein the first bottom joint includes the cylindrical portion of the bottom panel.

9. The storage container of claim 8, wherein the cylindrical portion is a first cylindrical portion disposed on an edge of the bottom panel and the first bottom joint further includes:

a second cylindrical portion disposed on a first side of the edge of the bottom panel; and a third cylindrical portion disposed on a second side of the edge of the bottom panel, the second side different than the first side.

10. The storage container of claim 1, wherein the second side panel portion includes a third face opposite the second face, the third face parallel to and abutting the back panel in the collapsed position.

11. The storage container of claim 1, wherein:

the first side panel portion is coupled to the front panel via a first piano joint; and the second side panel portion is coupled to the back panel via a second piano joint.

12. The storage container of claim 1, wherein:

the first side panel portion includes a receiving portion; and the second side panel portion includes a pin portion, the pin portion and the receiving portion forming a joint between the first side panel portion and the second side panel portion.

13. The storage container of claim 12, wherein the receiving portion extends from the first face.

14. A storage container movable between a deployed position and a collapsed position, the storage container comprising:

a front panel;

a back panel; and a side panel including:

a first side panel portion coupled to the front panel, the first side panel portion including a first face and a first edge; and a second side panel portion coupled to the back panel, the second side panel portion including a second face and a second edge, the first face coplanar with the second face in the deployed position, the first face parallel to and abutting the second face in the collapsed position, the second edge abutting the first edge in the deployed position, the first edge and the second edge forming a press-fit connection in the deployed position.

15. The storage container of claim 1, wherein the front panel includes a first end and the back panel includes a second end, the first end and the second end forming a continuous curved face in the collapsed position.

16. The storage container of claim 1, wherein:

the front panel includes a first bottom end including a protrusion; and the back panel includes a second bottom end including a channel, the protrusion and the channel forming an interface in the collapsed position.

17. The storage container of claim 16, wherein the protrusion is a first protrusion, the channel is a first channel, the interface is a first interface, the first bottom end includes a second channel, the second bottom end includes a second protrusion, and the second protrusion and the second channel forming a second interface in the collapsed position.

18. The storage container of claim 1, wherein the storage container has a first length in the deployed position, the storage container has a second length in the collapsed position, and a ratio of the first length to the second length is between 4 and 20.

19. The storage container of claim 1, wherein the tab is a first tab, the side panel includes a bottom edge, and the first side panel portion includes:

a protruding portion extending from the bottom edge; and a second tab extending from the protruding portion, the second tab supporting the bottom panel in the deployed position.

20. The storage container of claim 19, wherein the protruding portion is a first protruding portion and the second side panel portion includes:

a second protruding portion extending from the bottom edge, the second protruding portion abutting the first protruding portion; and a third tab extending from the second protruding portion, the third tab supporting the bottom panel in the deployed position.

* * * * *